US012590525B2

(12) United States Patent
Chen et al.

(10) Patent No.: US 12,590,525 B2
(45) Date of Patent: Mar. 31, 2026

(54) DRILLING FRAMEWORK

(71) Applicant: Schlumberger Technology Corporation, Sugar Land, TX (US)

(72) Inventors: Wei Chen, Katy, TX (US); Zhengxin Zhang, Houston, TX (US); Yuelin Shen, Houston, TX (US); Tien Hiep Nguyen, Cambridge (GB); Gregory Skoff, Houston, TX (US); Xianxiang Huang, Houston, TX (US); Zhenyu Chen, Beijing (CN); Tao Yu, Beijing (CN); Nathaniel Wicks, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/355,076

(22) Filed: Jul. 19, 2023

(65) Prior Publication Data

US 2024/0026769 A1 Jan. 25, 2024

Related U.S. Application Data

(60) Provisional application No. 63/368,981, filed on Jul. 21, 2022.

(51) Int. Cl.
*E21B 44/00* (2006.01)

(52) U.S. Cl.
CPC ..... *E21B 44/00* (2013.01); *E21B 2200/20* (2020.05)

(58) Field of Classification Search
CPC ..... E21B 2200/20; E21B 44/00
See application file for complete search history.

(56) References Cited

U.S. PATENT DOCUMENTS

| | | | | |
|---|---|---|---|---|
| 2015/0014058 | A1 | 1/2015 | Wassell et al. | |
| 2015/0081221 | A1* | 3/2015 | Mancini | E21B 49/003 702/9 |
| 2018/0051552 | A1* | 2/2018 | Li | E21B 47/024 |
| 2018/0171775 | A1* | 6/2018 | Santos | E21B 21/08 |
| 2021/0062634 | A1* | 3/2021 | Madasu | E21B 44/02 |
| 2022/0178240 | A1* | 6/2022 | Aman | E21B 45/00 |

FOREIGN PATENT DOCUMENTS

WO 2022132173 A1 6/2022

OTHER PUBLICATIONS

Search Report and Written Opinion of International Patent Application No. PCT/US2023/070501 dated Nov. 6, 2023, 8 pages.

Pastusek, P. et al., "Drilling Interbedded and Hard Formations with PDC Bits Considering Structual Integrity Limits", SPE 189608-MS, presented at the IADC/SPE Drilling Conference and Exhibition held in Fort Worth, Texas, U.S.A., 2018, 13 pages.

* cited by examiner

*Primary Examiner* — Caroline N Butcher
(74) *Attorney, Agent, or Firm* — Jeffrey D. Frantz

(57) ABSTRACT

A method may include generating an optimal operational window (OOW) that specifies operational parameter values for drilling operations using equipment at a rig site, based on data indicative of rig state and formation characteristics, and based on mutation-based optimization of the operational parameter values; and instructing a control system to perform the drilling operations according to the OOW using the equipment at the rig site.

20 Claims, 25 Drawing Sheets

600

1500

DRILLING FRAMEWORK

RELATED APPLICATIONS

This application claims priority to and the benefit of a US Provisional Application having Ser. No. 63/368,981, filed 21 Jul. 2022, which is incorporated by reference herein in its entirety.

BACKGROUND

A reservoir may be a subsurface formation that may be characterized at least in part by its porosity and fluid permeability. As an example, a reservoir may be part of a basin such as a sedimentary basin. A basin may be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.). Where a reservoir includes producible hydrocarbon fluids, one or more wells drilled at one or more wellsites may provide for production of such hydrocarbon fluids.

Operations at a wellsite involve a range of activities using many different tools and equipment. A wellsite team, during planning and operations, makes decisions about what parameters to use for equipment when performing various well construction tasks, which may depend on factors such as condition of the equipment, the nature of the formation, objectives, amongst other factors. For example, if stick slip conditions are encountered, equipment may be controlled to lower the weight on bit (WOB) and increase rotational speed of a drill bit (e.g., drill bit RPM); noting that a drill bit may be rotated via one or more mechanisms (e.g., a top drive, a mud motor, etc.).

Much of the knowledge of how to set appropriate parameters, trade-offs associated with different parameter values, and how different parameters lead to different results is known by experienced personnel. As a result, less experienced personnel may not have the experience to make the same decisions as experienced personnel. And, even among experienced teams, the team's understanding is based on its own experience and may not be appropriate for each circumstance. As a result, parameters actually implemented to perform field operations may vary in a manner that may lead to inconsistent results and quality. For example, where two teams are operating rigs to drill two different boreholes at two different wellsites for a common reservoir, depending on expertise, convention, etc., selected parameters and/or parameter values may differ, which may lead to differences in the resulting boreholes, which may concern borehole quality. Borehole quality may be determined using one or more of various metrics. For example, consider one or more of borehole stability (e.g., geomechanical stability), amount of reservoir contact, borehole trajectory with respect to plan, etc. Borehole quality may impact completions, including completions operations and completions equipment, along with production of hydrocarbon fluids.

SUMMARY

A method may include generating an optimal operational window (OOW) that specifies operational parameter values for drilling operations using equipment at a rig site, based on data indicative of rig state and formation characteristics, and based on mutation-based optimization of the operational parameter values. The method may also include instructing a control system to perform the drilling operations according to the OOW using the equipment at the rig site. A system may include at least one processor; memory accessible to at least one of the at least one processor; processor-executable instructions stored in the memory and executable to instruct the system to: generate an optimal operational window (OOW) that specifies operational parameter values for drilling operations using equipment at a rig site, based on data indicative of rig state and formation characteristics, and based on mutation-based optimization of the operational parameter values. The system may also include instructions to instruct a control system to perform the drilling operations according to the OOW using the equipment at the rig site. One or more non-transitory computer-readable storage media may include processor-executable instructions to instruct a computing system to: generate an optimal operational window (OOW) that specifies operational parameter values for drilling operations using equipment at a rig site, based on data indicative of rig state and formation characteristics, and based on mutation-based optimization of the operational parameter values. The one or more non-transitory computer-readable storage media may also include instructions to instruct a control system to perform the drilling operations according to the OOW using the equipment at the rig site. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The following detailed description refers to the accompanying drawings. Wherever convenient Features and advantages of the described implementations may be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
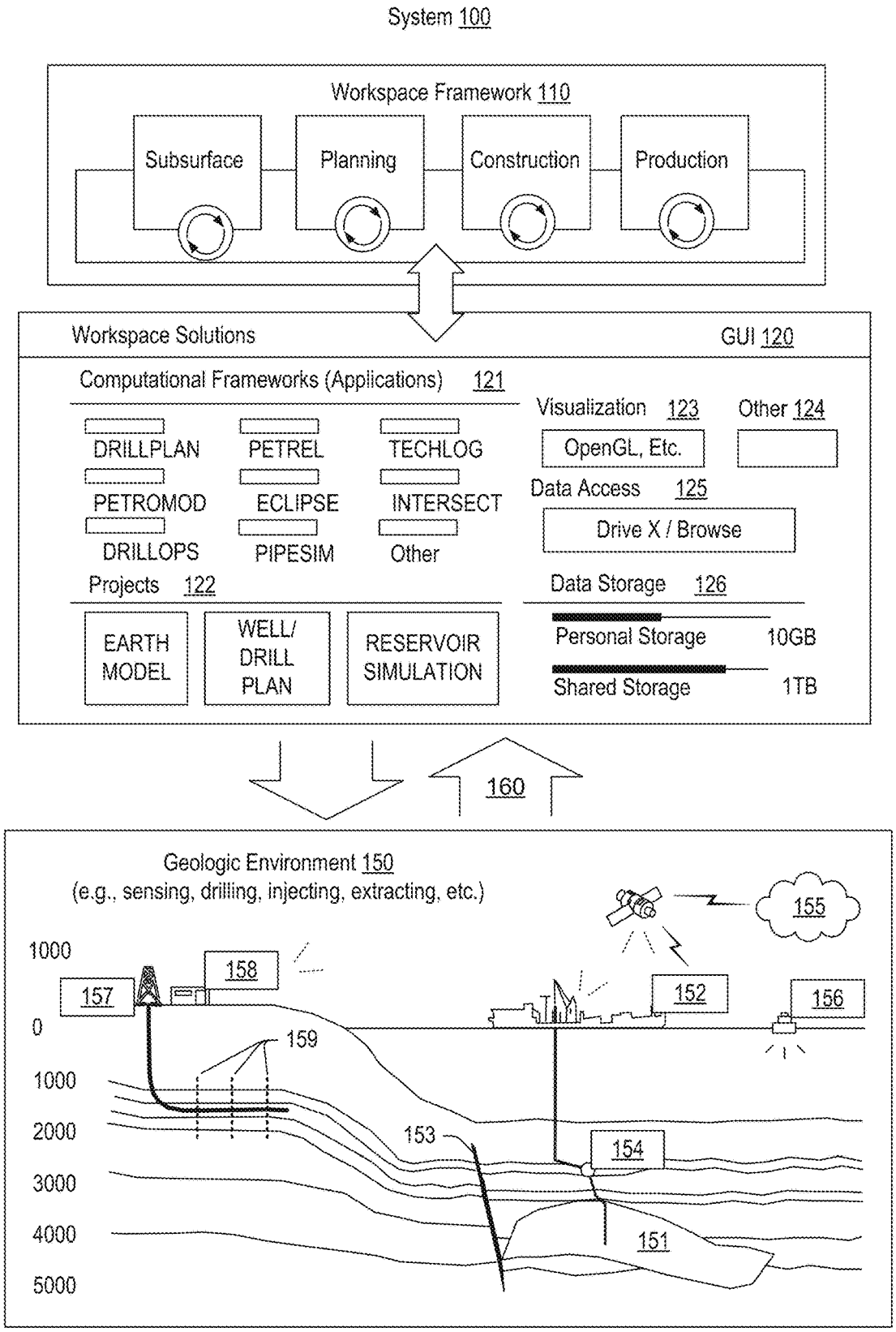
FIG. 1 shows an example of a system.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications, etc.) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, DRILLOPS, PETREL, TECHLOG, PETROMOD, ECLIPSE, PIPESIM, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically for individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework may be part of the DELFI environment for utilization in geosciences and geoengineering, for example, to analyze subsurface data from exploration to production of fluid from a reservoir. The DELFI cognitive exploration and production (E & P) environment (SLB, Houston, Texas), referred to herein as the DELFI environment or DELFI framework, is a secure, cognitive, cloud-based collaborative environment that integrates data and workflows with digital technologies, such as artificial intelligence and machine learning.

The PETREL framework provides components that allow for optimization of various exploration, development and production operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases. For example, a workflow may utilize one or more of the DELFI environment on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150 and, feedback 160, may be received via one or more interfaces in one or more forms (e.g., acquired data as to operational conditions, equipment conditions, environment conditions, etc.).

As an example, a workflow may progress to a geology and geophysics ("G & G") service provider, which may generate a well trajectory, which may involve execution of one or more G & G frameworks (e.g., consider the PETREL framework, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

While several simulators are illustrated in the example of FIG. 1, one or more other simulators may be utilized, additionally or alternatively. For example, consider the VISAGE geomechanics simulator (SLB, Houston Texas) or the PIPESIM network simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, CO2 disposal, etc. The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena. The MANGROVE simulator (SLB, Houston, Texas) provides for optimization of stimulation design (e.g., stimulation treatment operations such as hydraulic fracturing) in a reservoir-centric environment. The MANGROVE framework may combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework may provide results pertaining to heterogeneous interactions between hydraulic and natural fracture networks, which may assist with optimization of the number and location of fracture treatment stages (e.g., stimulation treatment(s)), for example, to increased perforation efficiency and recovery.

As an example, a tool may be positioned to acquire information in a portion of a borehole. Analysis of such information may reveal vugs, dissolution planes (e.g., dissolution along bedding planes), stress-related features, dip events, etc. As an example, a tool may acquire information that may help to characterize a fractured reservoir, optionally where fractures may be natural and/or artificial (e.g., hydraulic fractures). Such information may assist with completions, stimulation treatment, etc. As an example, information acquired by a tool may be analyzed using a framework such as the aforementioned TECHLOG framework.

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

In the example of FIG. 1, drilling may be performed in the geologic environment 150, for example, to access the reservoir 151, which may be accessed from land or offshore. In FIG. 1, the downhole equipment 154 may be, for example, part of a bottom hole assembly (BHA). The BHA may be used to drill a well. The downhole equipment 154 may communicate information to equipment at the surface, and may receive instructions and information from the equipment at the surface. During a well construction process, a variety of operations (such as cementing, wireline evaluation, testing, etc.) may be conducted. In such embodiments, data collected by tools and sensors and used for reasons such as reservoir characterization may be collected and transmitted.

A well may include a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
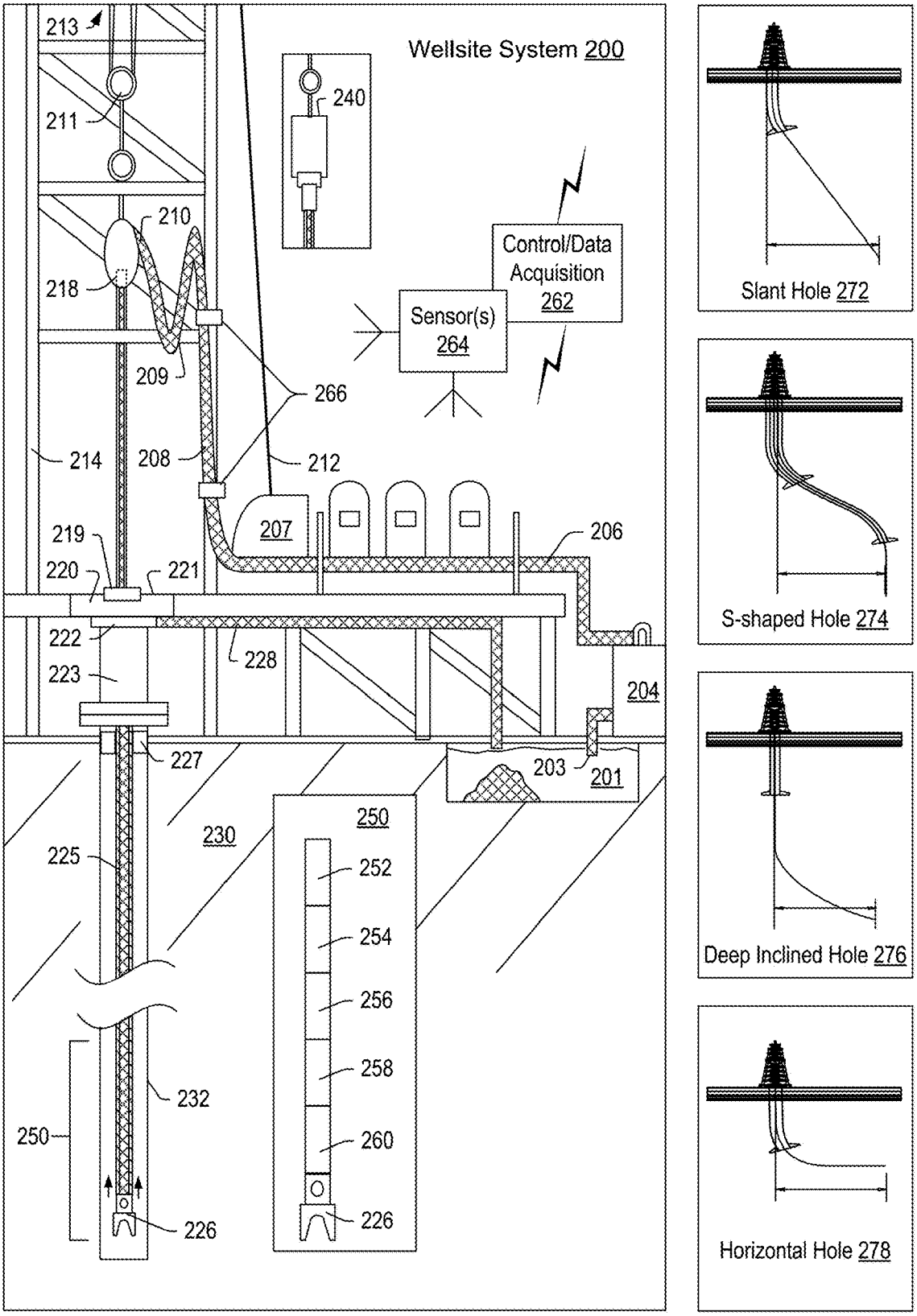
FIG. 2 shows an example of a system.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the vibrating hose 206, the standpipe 208, and the kelly hose 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a mud motor (e.g., PDM) may be operated in different modes, which may include a rotating mode and a sliding mode. A sliding mode involves drilling with a mud motor rotating the bit downhole without rotating the drillstring from the surface. Such an operation may be conducted when a BHA has been fitted with a bent sub or a bent housing mud motor, or both, for directional drilling. Sliding may be used in building and controlling or adjusting hole angle. In directional drilling, pointing of a bit may be accomplished through a bent sub, which may have a relatively small angle offset from the axis of a drillstring, and a measurement device to determine the direction of offset. Without turning the drillstring, the bit may be rotated with mud flow through the mud motor to drill in the direction it is pointed. With steerable motors, when a desired wellbore direction is attained, the entire drillstring may be rotated to drill straight rather than at an angle. By controlling the amount of hole drilled in the sliding mode versus the rotating mode, a wellbore trajectory may be controlled rather precisely.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface. In such an example, a bit RPM may be determined or estimated based on the RPM of the mud motor.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 (e.g., an LWD tool) may be housed in a suitable type of drill collar and may contain one or a plurality of selected types of logging tools. It will also be understood that more than one LWD and/or MWD module may be employed, for example, as represented by the module 256 of the drillstring assembly 250. Where the position of an LWD module is mentioned, as an example, it may refer to a module at the position of the LWD module 254, the module 256, etc. An LWD module may include capabilities for measuring, processing, and storing information, as well as for communicating with the surface equipment. In the illustrated example, the LWD module 254 may include a seismic measuring device.

The MWD module 256 (e.g., an MWD tool) may be housed in a suitable type of drill collar and may contain one or more devices for measuring characteristics of the drillstring 225 and the drill bit 226. As an example, the MWD tool 256 may include equipment for generating electrical power, for example, to power various components of the drillstring 225. As an example, the MWD tool 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or of a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; an MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that may not be rotated or moved axially. As an example, a condition referred to as "differential sticking" may be a condition whereby the drillstring may not be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

As to stick slip, it may be a form of torsional vibration that occurs when a drill bit, bottom hole assembly (BHA) and/or drillstring experience different rotational speeds than expected. For example, during a "stick" phase, rotation at the drill bit may slow down or even stop where reactive torque may build-up in the drillstring. Such a build-up of torque and/or one or more other forces may result in a "slip" phase where the drillstring (e.g., or a portion thereof) becomes unstuck and rotates. Stick slip may exhibit oscillatory types of behavior. Where a mud motor is included on a drillstring, drill bit related stick slip may be somewhat reduced, however, stick slip above the mud motor may still occur. In various examples, stick slip behavior and where it occurs may depend on equipment utilized, for example, whether a mud motor is utilized, etc.

Figure 3:
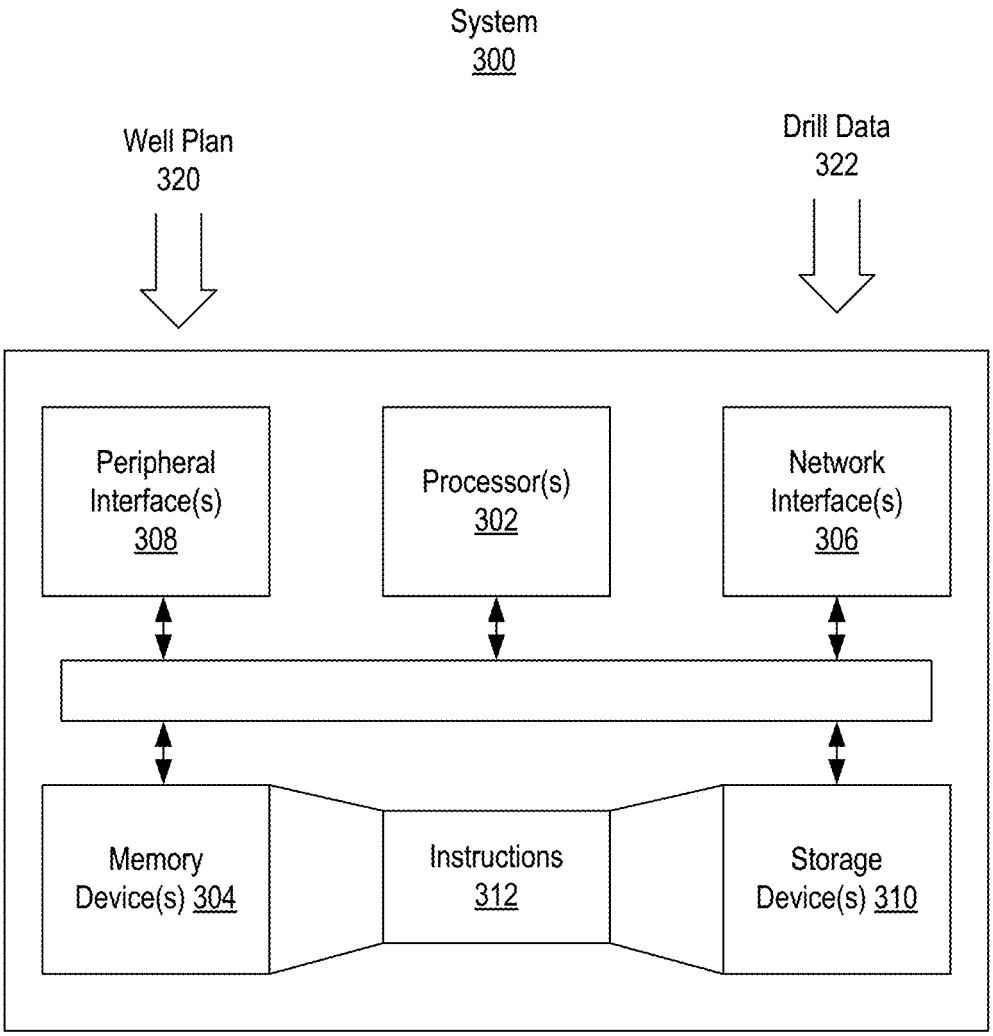
FIG. 3 shows an example of a system.

FIG. 3 shows a schematic view of a computing or processor system 300, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc., such as flash drives, hard drives, disks, random access memory, etc., for storing data, such as images, files, and program instructions for execution by the processor 302. In an embodiment, the computer-readable media 304 may store instructions that, when executed by the processor 302, are configured to cause the processor system 300 to perform operations. For example, execution of such instructions may cause the processor system 300 to implement one or more portions and/or embodiments of the method(s) described above.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

In the example of FIG. 3, the memory device 304 may be physically or logically arranged or configured to store data on one or more storage devices 310. The storage device 310 may include one or more file systems or databases in any suitable format. The storage device 310 may also include one or more sets of instructions 312, which may contain interpretable and/or executable instructions for performing one or more of the disclosed processes (e.g., processor-executable instructions storable in the memory 304 and executable to instruct the system 300 to perform one or more actions). When requested by the processor 302, one or more of the one or more sets of instructions 312, or a portion thereof, may be loaded from the storage devices 310 to the memory devices 304 for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320 (e.g., and/or to generate a directional drilling well plan). As discussed above, a well plan to the description of the proposed wellbore is to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan may also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as weight on bit (WOB), rate of penetration (ROP), torque, or others), text information entered by individuals working at the wellsite, or other data collected during the construction of the well.

In one embodiment, the processor system 300 is part of a rig control system (RCS) for the rig (e.g., including downhole equipment operatively coupled to the rig). In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

A well plan 320 typically includes information about the direction and shape of a well to be drilled. The well plan 320 may include information about parameters and tools to use to achieve the desired shape and position. However, as the well is being drilled, the actual trajectory may deviate from the plan or unanticipated conditions may be encountered. In such instances, and others, the plan may need to be adjusted to account for changing conditions and circumstances. For example, consider a method that may call for re-planning to generate a revised well plan.

In one embodiment, a system includes a well plan component for monitoring and updating the well plan where the well plan may be in a digital format, for example, as a digital data structured stored in memory of a computing device, a computing system, etc. For example, consider a controller that includes memory that may store a well plan as a digital file or digital files. The well plan component may derive a working plan when a team takes a survey or otherwise determines a position of a well. In one embodiment, the working plan is, in effect, a spatial trajectory in multiple dimensions to construct a path from a current bit location (e.g., hole bottom position) to a next location, which may be referred to as a target, which may be an intermediate target or a final target. The construction of the path takes into account a variety of considerations. These may include, but are not limited to: the target; the allowable deviation from the original plan in terms of position and/or angular deviation; the maximum dogleg capability of the steering assembly; constraints set by the user at the beginning based on preference; allowable tortuosity, risk measures, hole quality, confidence level, etc.; and others.

As an example, a computation framework may provide an automated optimum operating window (OOW) that is data-driven and utilizes domain knowledge. For example, consider a framework that may implement a workflow that utilizes historical data from offset wells and drilling domain knowledge to create an OOW systematically and automatically for a planned well with consideration of shock and vibration (S & V) optimization. Such a workflow may include multiple stages. For example, consider a first stage where data for processing and visualization are received via a well construction data foundation platform (WCDF) and presented using a cloud-based platform (e.g., MICROSOFT AZURE, AMAZON AWS, GOOGLE CLOUD, etc.). As an example, in a subsequent stage, framework features for drilling dynamics interpretations (e.g., consider features of the TECHLOG framework) may provide for transmission of OOW information to one or more wellsites, optionally without introducing an additional web-based application. In such an approach, the framework may utilize data such as, for example, depth-based data, formation tops and drilling domain knowledge to establish appropriate drilling parameters for an OOW. In such an approach, depth-based data may be cleaned, for example, by removing outliers, unrealistic values using domain knowledge. As an example, a formation tops naming process may be based on a defined dictionary. As an example, a joined dataset for selected offset wells between depth channels and formation tops may be created using one or more alignment processes. As an example, data may be processed to generate statistical ranges (P0, P10 . . . to P90, P100) for each of one or more parameters where, for example, various channels may be processed for per each formation (and into sub-formations)

and one or more shock and vibration states. A framework may utilize domain knowledge in a process that aims to find appropriate OOW parameters per each formation, which may be deemed appropriate based on one or more shock and vibration (S & V) metrics (e.g., consider lowest practical shock and vibration). The resulting OOW from offset wells may then be mapped into a planned well. In various examples, an OOW may be generated in a manner that considers rate of penetration (ROP) as a performance metric and/or steerability of a drill bit (e.g., predictive steering). As explained, an OOW may be transmitted to a wellsite for implementation such that a borehole may be drilled or further drilled with improved assurances as to consistency amongst boreholes in a field, borehole quality, operational procedures, etc.

Utilization of a framework for OOW generation may help bring a manual, legacy drilling roadmap into a field day-to-day monitoring and/or control system, which may be operable using one or more frameworks such as, for example, one or more frameworks that include features of one or more of the TECHLOG framework, the PERFORM TOOL KIT (PTK) framework (SLB, Houston, Texas), the DRILLPLAN framework, and the DRILLOPS framework. In such an approach, an OOW may help to improve performance and reduce equipment damage due to shock and vibration.

As an example, an OOW may provide values for various drilling parameters, which may include, for example, WOB, RPM and flow rate (e.g., mud flow rate). As an example, an OOW generation framework may be operated using offset well data from one or more regions and/or types of wells. For example, consider use of data from Middle East gas wells that have data available from the OPTIDRILL framework (SLB, Houston, Texas) in a number of sections (e.g., well sections of different diameter, etc.). As another example, consider data from wells in the Permian Basin. Data may include, for example, data from one or more surface sensors and/or one or more downhole sensors or sensor packages. For example, as to downhole sensor data, consider MWD sensor data, LWD sensor data, RSS sensor data, etc. As an example, an OOW framework may be tailored to equipment. For example, consider tailoring an OOW framework for outputting an OOW for use with a drillstring that includes an MWD tool without one or more additional sensors or, for example, a drillstring that includes an MWD tool and an RSS tool, which provides additional sensors.

Figure 4:
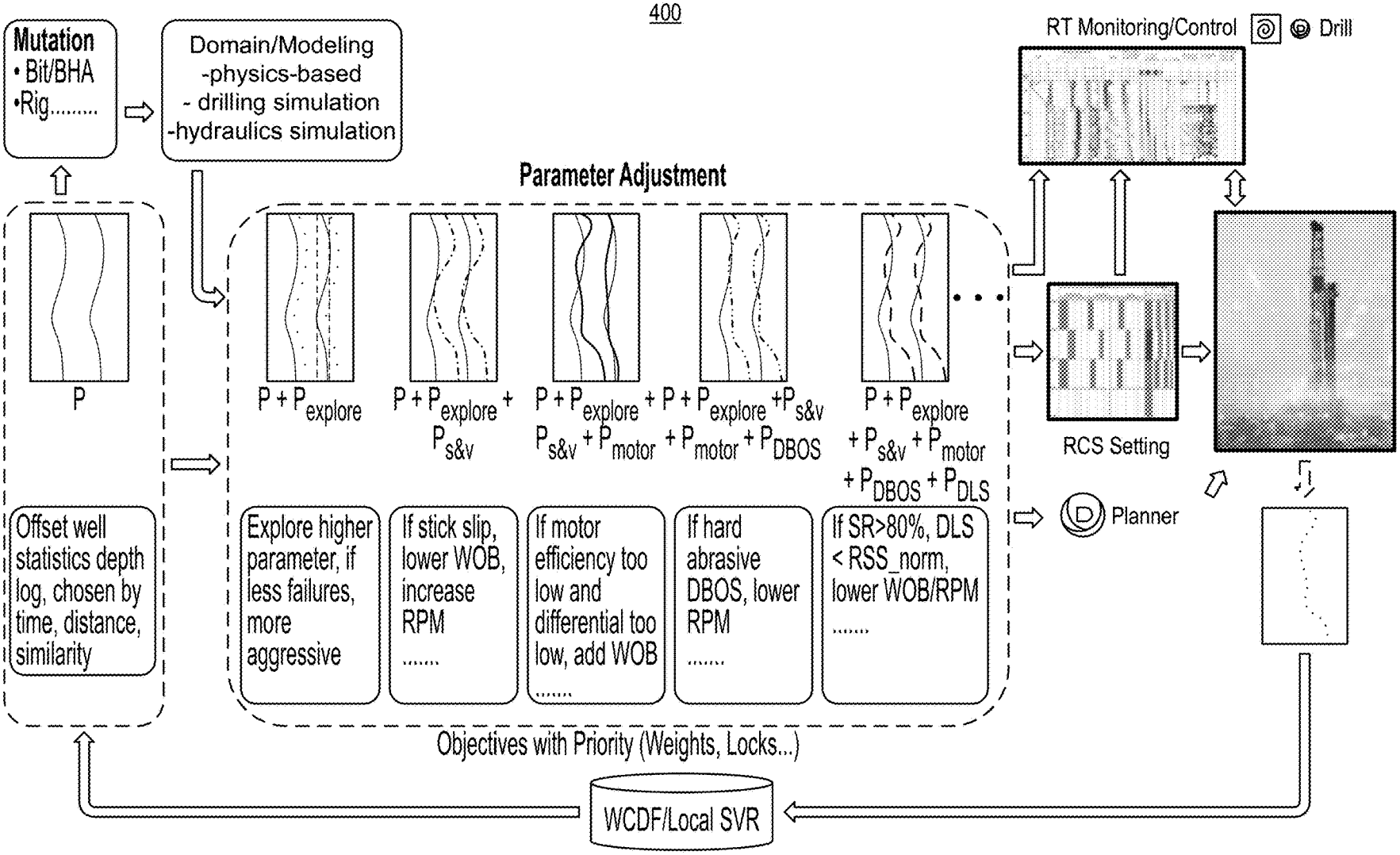
FIG. 4 shows an example of a workflow.

FIG. 4 shows an example of a OOW workflow 400 that includes various framework features. As shown, the workflow 400 may progress from parameter (P) information from a WCDF and/or other data source where mutations may be generated to provide for enhanced domain assessment and/or modeling. In such an example, the mutations may be variations such as genetic types of variations in P information such that a fuller range of domain assessment and/or modeling may be performed. For example, consider utilization of one or more types of models, which may be physics-based, data-driven, hybrid, etc. In the example of FIG. 4, a drilling simulation model (e.g., IDEAS simulator, SLB, Houston, Texas) is shown, along with a hydraulics simulator (e.g., drilling fluid simulator, etc.). Through use of mutations, impacts of different parameter values may be explored, as indicated by $P_{explore}$.

As an example, a mutation process may aim to explore parameter values that may provide for improved drilling, which may be improved drilling time, improved ROP, lesser non-productive time (NPT), improved borehole quality, improved equipment utilization (e.g., less equipment damage, etc.), etc. In such an approach, mutations may be biased toward improved drilling. As shown in FIG. 4, exploration may aim to determine if fewer failures may be experienced for parameter values that provide for more aggressive drilling (e.g., higher ROP, etc.). Hence, as an example, a mutation-based approach may account for risks, while also being biased toward improved drilling.

In the example of FIG. 4, the workflow 400 may progress to a shock and vibration (S & V) assessment. Such an assessment may aim to determine whether stick slip may occur and, if so, to decrease WOB and increase RPM. In instances where a mud motor is utilized, the workflow 400 may include an assessment as to motor efficiency, where, if efficiency is low and differential pressure is too low, WOB may be increased. As an example, the workflow 400 may include a formation-based assessment, which may provide for assessing parameters for drilling into a relatively hard formation layer. For example, if a formation layer is hard and abrasive, then one or more parameter values may be adjusted such as, for example, to lower RPM, which may provide for drill bit optimization where the workflow 400 implements a drill bit optimization system (DBOS) feature. In the example of FIG. 4, the workflow 400 may include an RSS related assessment. For example, consider an assessment that is based on comparing an RSS steering (SR) parameter to a threshold (e.g., SR>80 percent) and the actual DLS to a threshold (e.g., DLS<nominal DLS yield of RSS) or the planned borehole trajectory DLS, to make a determination as to whether one or more parameter values are to be adjusted (e.g., lower WOB, lower RPM, etc.).

In the example of FIG. 4, output may be directed to one or more destinations. For example, consider real-time monitoring and/or control destinations, a planning destination, etc. As an example, where implementation occurs of an OOW at a wellsite for drilling operations, parameter values, data, etc., may be utilized as feedback and/or as offset well data.

As explained, the workflow 400 of FIG. 4 may provide for data-driven and domain knowledge-drive OOW evolution. As to "evolution", it may be performed using mutation. As explained, mutation may aim to improve upon existing experiences for drilling operations such that a target well may be more optimally drilled, etc.

In one embodiment, a framework may provide for implementing a workflow that involves performing data synchronization. In certain embodiments, data (e.g., surface and tool dump data) may be misaligned due to, for example, time difference, power generation cycles, or other reasons. A time synchronization process may automatically synchronize paired surface and downhole data. In certain embodiments, synced data sets may be selected for processing.

As an example, a workflow may include data enrichment. For example, information as to rig state may be included for purposes of data enrichment. For example, data may be augmented with information on rig state, off-bottom HKLD, DWOB, DTOR, differential pressure, etc. Information for enrichment may also include motor efficiency and degradation information such as motor efficiency, degradation, power, and torque. Further enrichment data may include mechanical specific energy (MSE), downhole MSE (DMSE), torque loss, etc. As an example, enrichment data may include bit characteristics indices such as aggressiveness, formation stiffness, penetration per revolution, etc.

As to MSE, it is a measure of drilling efficiency and may be defined as the energy required to remove a unit volume of rock. For optimal drilling efficiency, an objective may be to minimize MSE and to maximize ROP. To control the MSE, one or more of WOB, torque, ROP, and drill bit RPM may be adjusted.

As an example, a framework may provide for receiving data indicative of state (e.g., rig state), along with one or more S & V types of data and one or more energy types of data, which may include, for example, one or more MSE types of data (e.g., energy experienced by a drill bit, etc.). As an example, a framework may generate an OOW using data indicative of state, one or more S & V statistics, bit index, formation stiffness, and DMSE. As an example, a bit index (BI) may be a metric that characterizes a drill bit, which may be applied on a new type of formation and bit database (e.g., consider a formation drillability catalog (FDC)). As explained, motor efficiency and degradation may be utilized. As an example, a framework may operate using a number of surface channels (e.g., WOB, ROP, STOR, FLWI, etc.); noting that downhole sensor data may supplement such surface channel data. As an example, a framework may include receiving data from a controller such as, for example, an autodriller controller. For example, consider control commands, control feedback, control adjustments, etc., which may be available for one or more boreholes drilled using an automated drilling controller.

As an example, an OOW may be suitable for consumption by one or more components of a rig control system (RCS), which may include one or more automated drilling controller components. As an example, an autodriller controller may be operable at one or more different levels of automation where, for example, more automation is possible where confidence may be sufficiently high. In such an example, confidence may be high due to one or more factors, which may pertain to one or more of equipment, downhole conditions, etc. As an example, an OOW may help to increase confidence and hence level of automation such that drilling may be performed with lesser human involvement. For example, where an OOW may provide appropriate information to a controller (e.g., as to values of drilling parameters, tuning, responses, etc.), the controller may operate with less intervention from a human. As explained, implementation in the field may result in feedback, which as explained, may be utilized as a basis for further drilling operations, whether at the same wellsite or one or more different wellsites. As an example, a framework may provide for transformation of information into command information suitable for utilization by one or more types of controllers.

As an example, a framework may operate dynamically where data are processed as they become available. For example, consider a field where boreholes are to be drilled at a number of sites. In such an example, upon completion of a few of the boreholes, there may be data sufficient for generation of one or more OOWs for boreholes to be drilled or further drilled. As an example, a framework may analyze available data and/or outputs to determine when an OOW is reliable for a given amount of data or when an OOW may become reliable (e.g., once an amount of future data are generated and received). As an example, a framework may implement a statistical approach to determining when an OOW is sufficient for deployment. As an example, a framework may operate according to one or more risk assessments where, an ability to assess risk and/or manage risk, may increase upon receipt of additional data. Hence, as more data become available, an OOW may be generated that aims to manage an increased amount of risk to achieve improved drilling (e.g., improved ROP, lesser equipment wear, improved borehole quality, etc.). As explained, as increased data may drive improved statistics, increased data may drive improved drilling with improved risk management. As an example, an OOW may be provided on a section-by-section basis or other incremental basis such that drilling operations may be tied to particular characteristics of a subsurface region to be drilled.

As explained, a framework may tie together rig states with formation characteristics, which may improve directional drilling operations, which may provide for vertical, curved, horizontal, etc., types of drilling using one or more types of modes (e.g., vertical mode, sliding mode, rotating mode, etc.). While vertical drilling may present fewer challenges than curved drilling (e.g., according to a desired DLS, etc.), vertical drilling may be optimized, for example, to reduce risks of excessive equipment wear, etc. As explained, a framework may implement a mutation process that aims to improve drilling, for example, such that drilling may be more aggressive with confidence that wear is acceptable. As to equipment wear, bit wear may be a concern, along with mud motor wear, where a mud motor is utilized. In various instances, a borehole may be drilled with a vertical portion, curved portion and lateral portion using a drillstring with a single BHA with a single drill bit. In such an example, an OOW may be generated that aims to preserve bit life such that the drill bit may drill the entire borehole without having to pull the drillstring out of the hole (POOH). As an example, an OOW may be segmented based on one or more factors, which may be by portion, by diameter, by type of formation to be drilled into, by expected S & V, etc.

As an example, a framework may implement one or more types of data science platforms. For example, consider the DATAIKU platform (DATAIKU, New York, New York), which includes various libraries for data processing.

Figure 5:
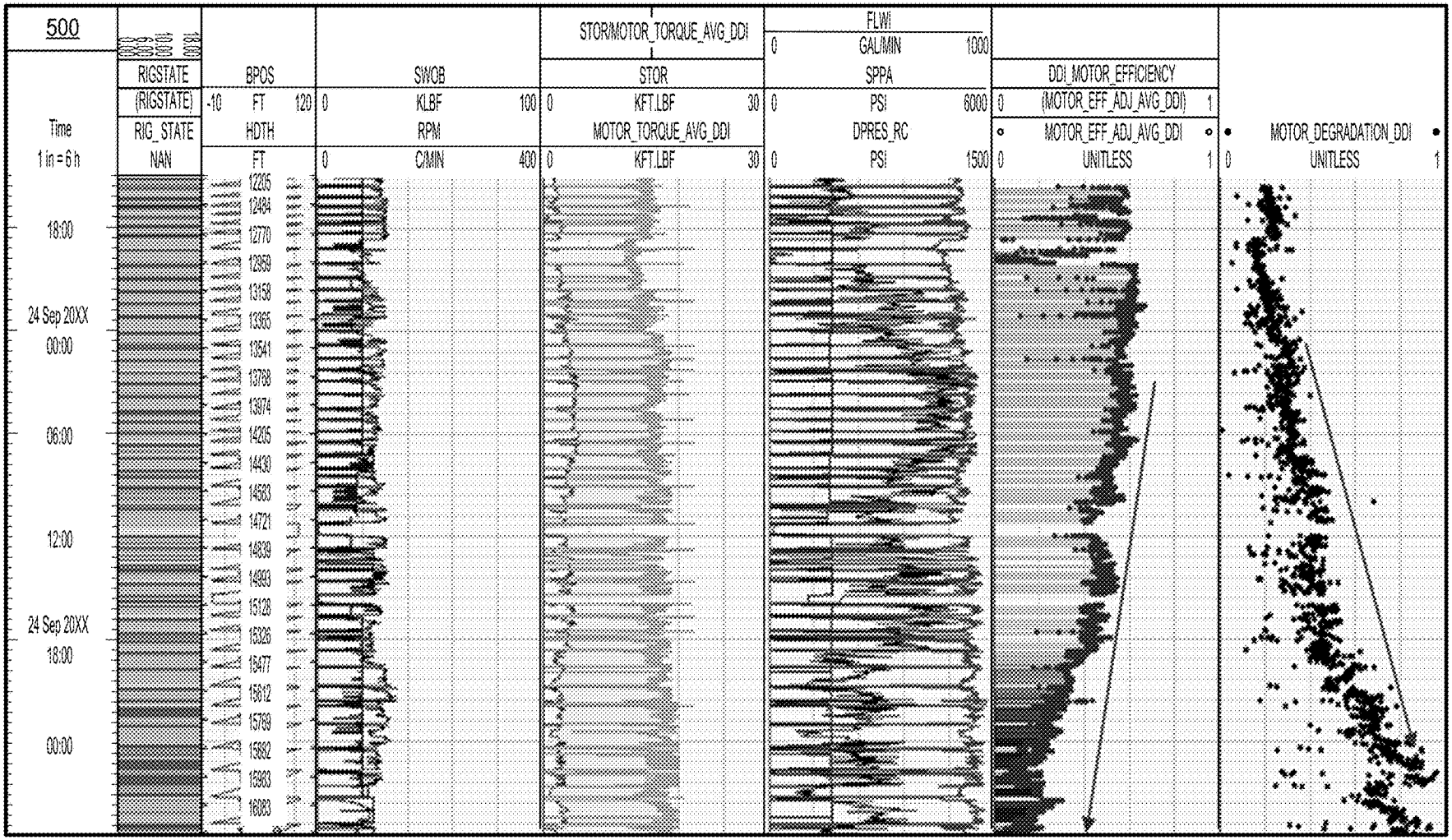
FIG. 5 shows an example of a graphical user interface (GUI)

FIG. 5 shows an example of a graphical user interface (GUI) 500 that includes various types of data, which may be rendered with respect to time and/or depth. As shown, the GUI 500 includes rig state, block position (BPOS), block height (HDTH), surface WOB (SWOB), RPM, motor torque, surface torque (STOR), flow rate (FLWI), standpipe pressure (SPPA), differential pressure (DPRES_RC), motor efficiencies, and motor degradation (e.g., wear of one or more downhole motor components).

Figure 6:
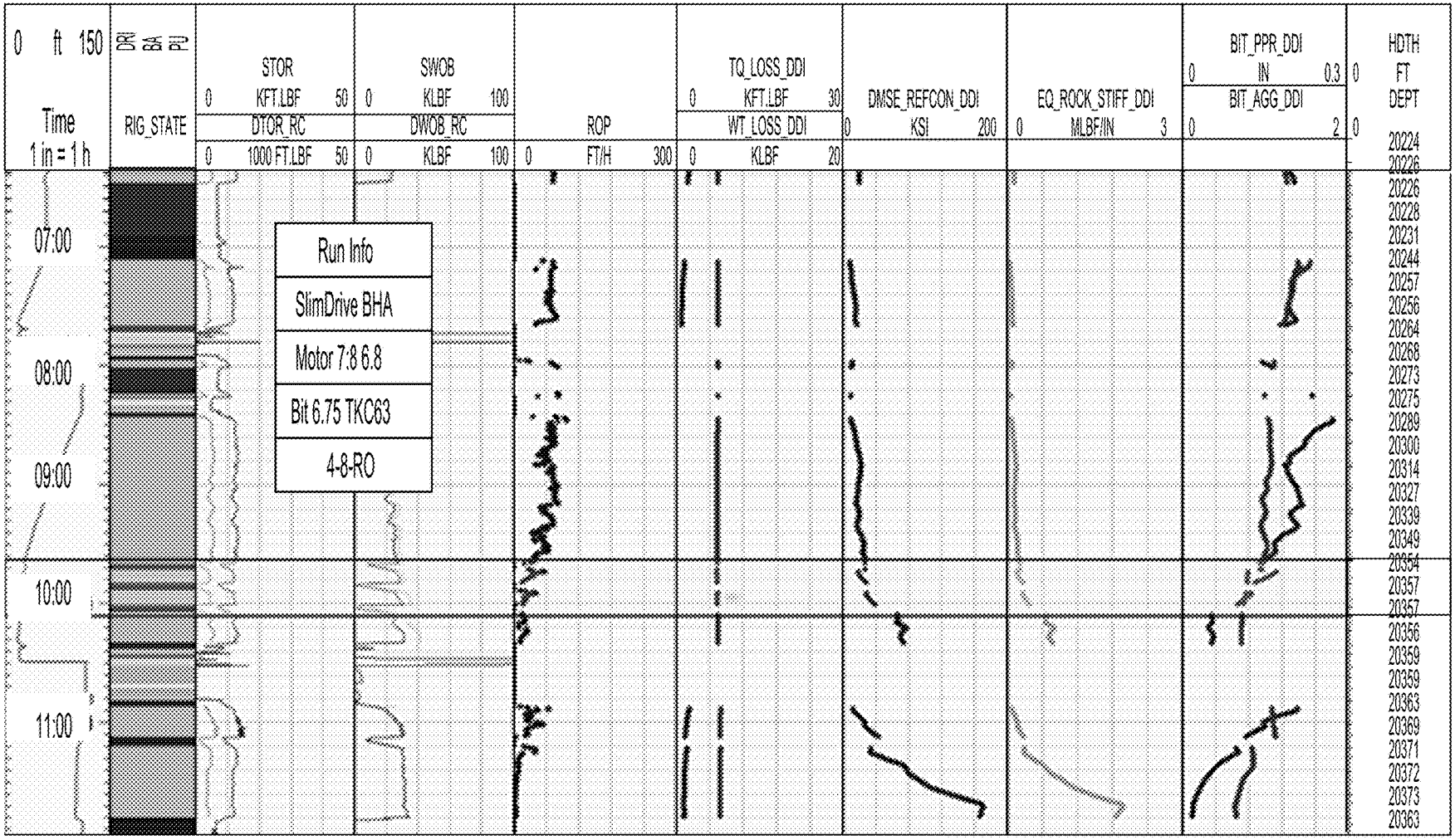
FIG. 6 shows an example of a graphical user interface (GUI)

FIG. 6 shows an example of a GUI 600 that includes various drill bit types of data. As shown, the GUI 600 may include drill bit wear data, along with equipment information as to a drill run.

Figure 7:
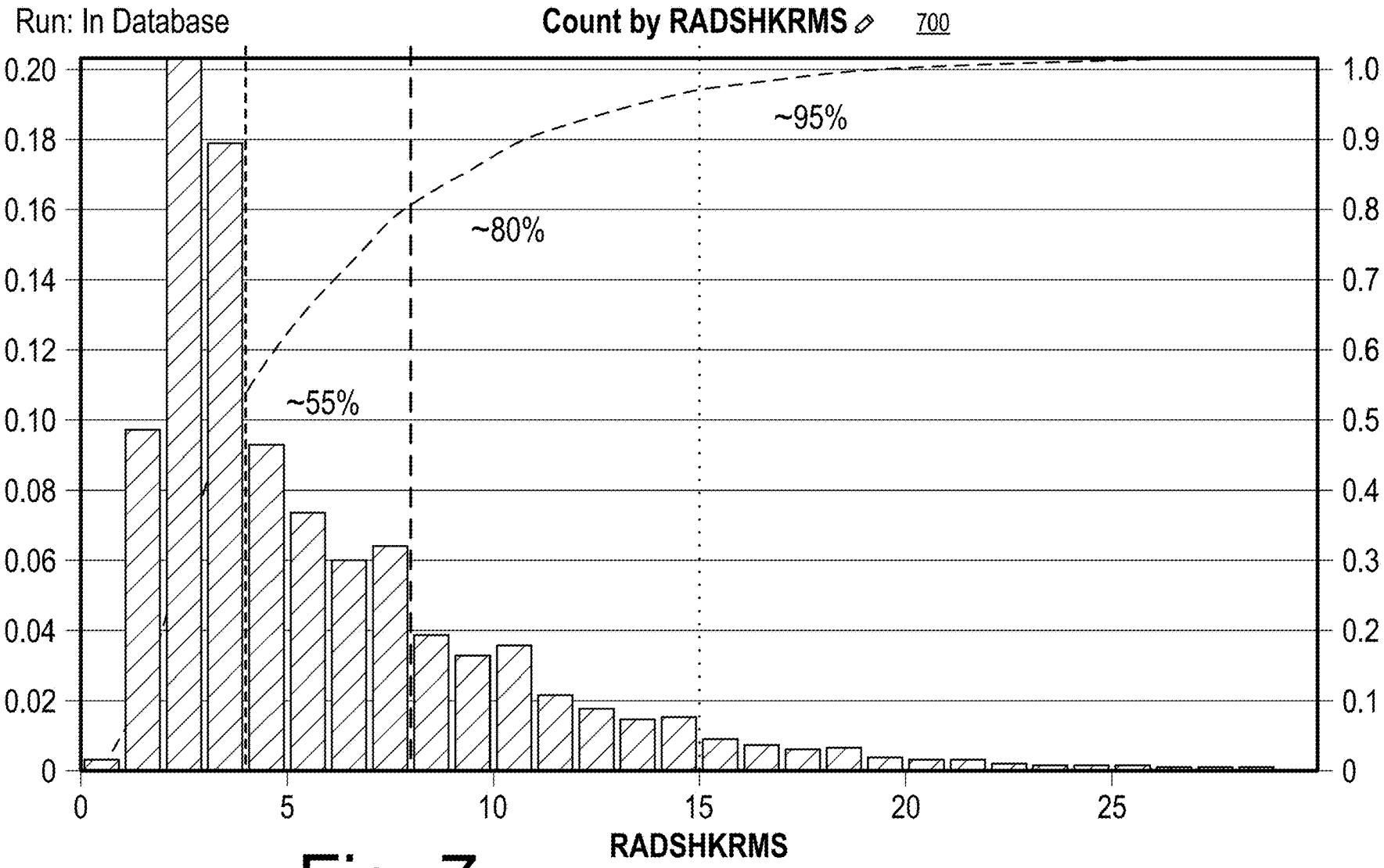
FIG. 7 shows an example of a graphical user interface (GUI)

FIG. 7 shows an example of a GUI 700 that includes a graph of radial shock RMS (RADSHKRMS) values histogram from over 10,000 rotary steerable tool (RSS drillstring) runs. Such statistics may be used to assess shock and vibration severity by comparing a single job to a large population of jobs. As an example, risk information in such a graph (e.g., statistics, etc.) may be used to in an OOW generation workflow.

Figure 8:
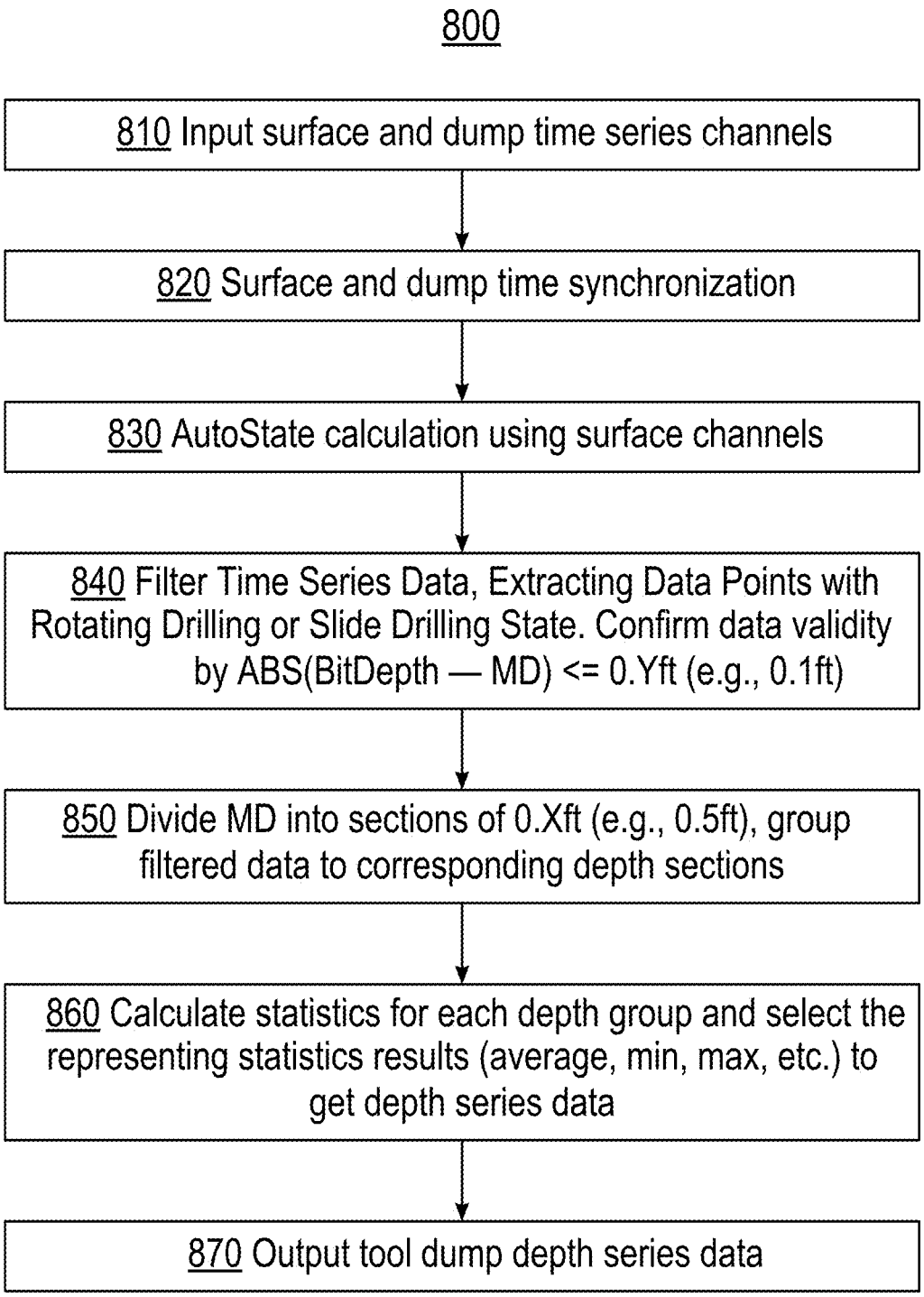
FIG. 8 shows an example of a workflow.

FIG. 8 shows an example of a method 800 that includes an input block 810 for input of surface and dump time series channels, a synchronization block 820 for synchronizing the surface and dump times of the data, an automatic state computation block 830 for automatically computing states (e.g., drill states, rig states, etc.) using surface channels data, a filter block 840 for filtering time series data and extracting data points that pertain to different drilling modes (e.g., rotating or sliding modes) along with data validity confirmation, a division block 850 for dividing measure depth (MD) sections into a desired incremental distance (e.g., 0.5 ft, etc.) for grouping filtered data to corresponding MD sections, a computation block 860 for computing statistics metrics for each MD group and for selecting representing statistics results (e.g., average, min, max, etc.) to provide MD series data, and an output block 870 to output tool dump MD series data. As explained, the method 800 may convert data from time series to depth series (e.g., MD or true vertical depth (TVD)).

Figure 9:
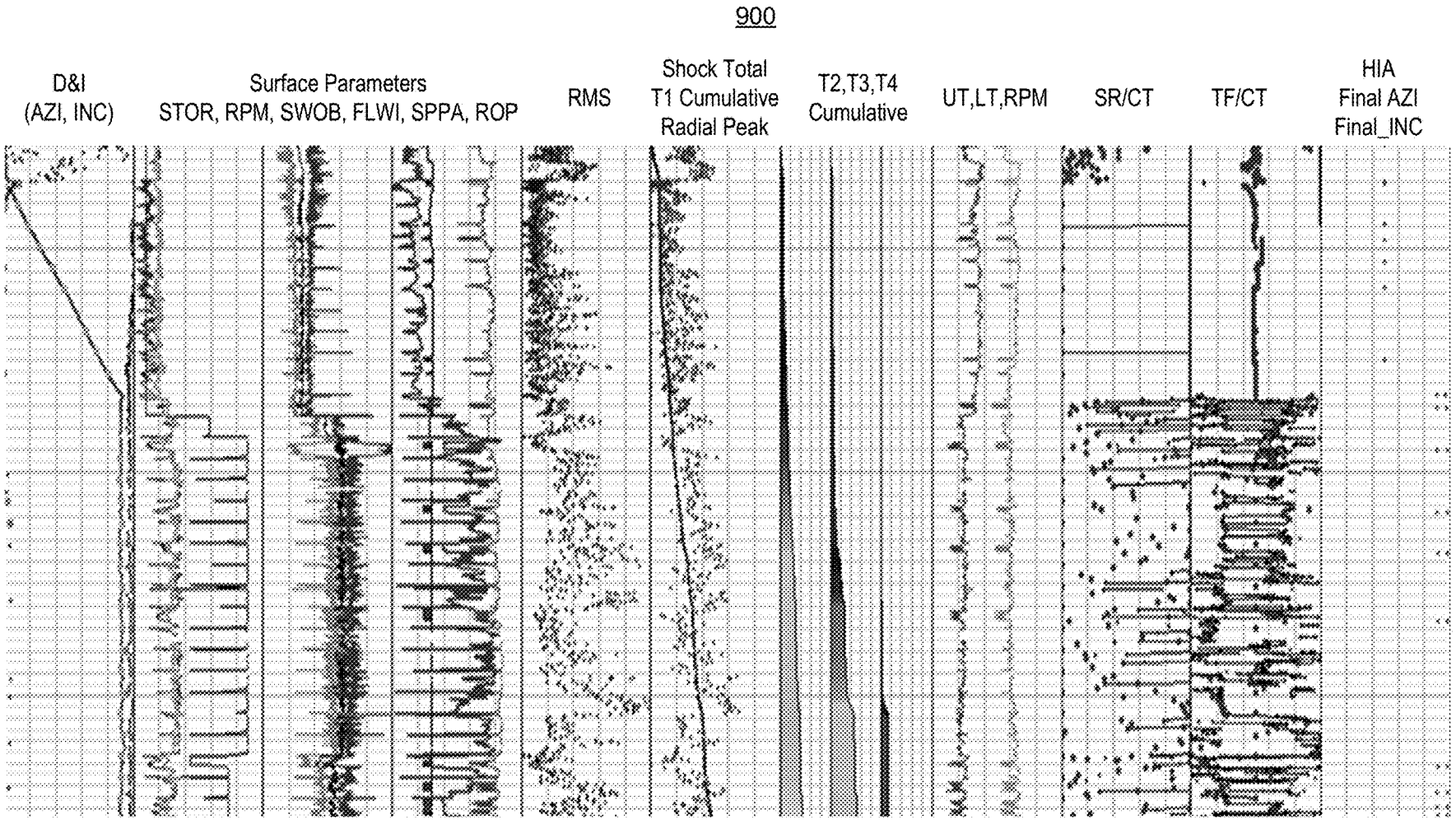
FIG. 9 shows an example of a graphical user interface (GUI)

FIG. 9 shows an example of a GUI 900 that includes various types of data. For example, consider direction and inclination (D & I) data, which may include inclination and azimuth data. As shown, the GUI 900 may include various types of surface data, which may include STOR, RPM, SWOB, minimum RPM, maximum RPM, average RPM, FLWI, SPPA, and ROP. As shown in the GUI 900, shock RMS shaking data (e.g., axial vibration and/or radial and/or tangential shock data from downhole sensors) may be included, which may include radial data and axial data. As shown, shock rate metrics may be determined and presented (e.g., T1, T2, T3, T4, etc.). As shown, turbine data of one or more RSS tool turbines may be presented in combination with RPM to diagnose RSS tool health, for example, for an upper torquer (UT) and a lower torquer (LT), which may be representative of operation of two turbines of an RSS tool. As an example, steering (SR), tool face (or toolface (TF)), and modes (e.g., hold inclination and azimuth (HIA), etc.), along with final azimuth setpoint (FINAL_AZI) and final inclination setpoint (FINAL_INC) may be included in the GUI 900. As an example, such data may be available from an RSS tool.

In the example of FIG. 9, the GUI 900 shows data for drilling operations where a borehole is being drilled with curvature and then horizontally. For example, the D & I data track shows such a transition occurring at approximately 9700 feet. In processing offset data, various types of drilling may be identified and segmented. For example, consider identifying a vertical portion, a curved portion and a horizontal portion. In such an example, drilling operations may differ for each portion. As explained, an OOW may account for different portions of a borehole to be drilled.

Figure 10:
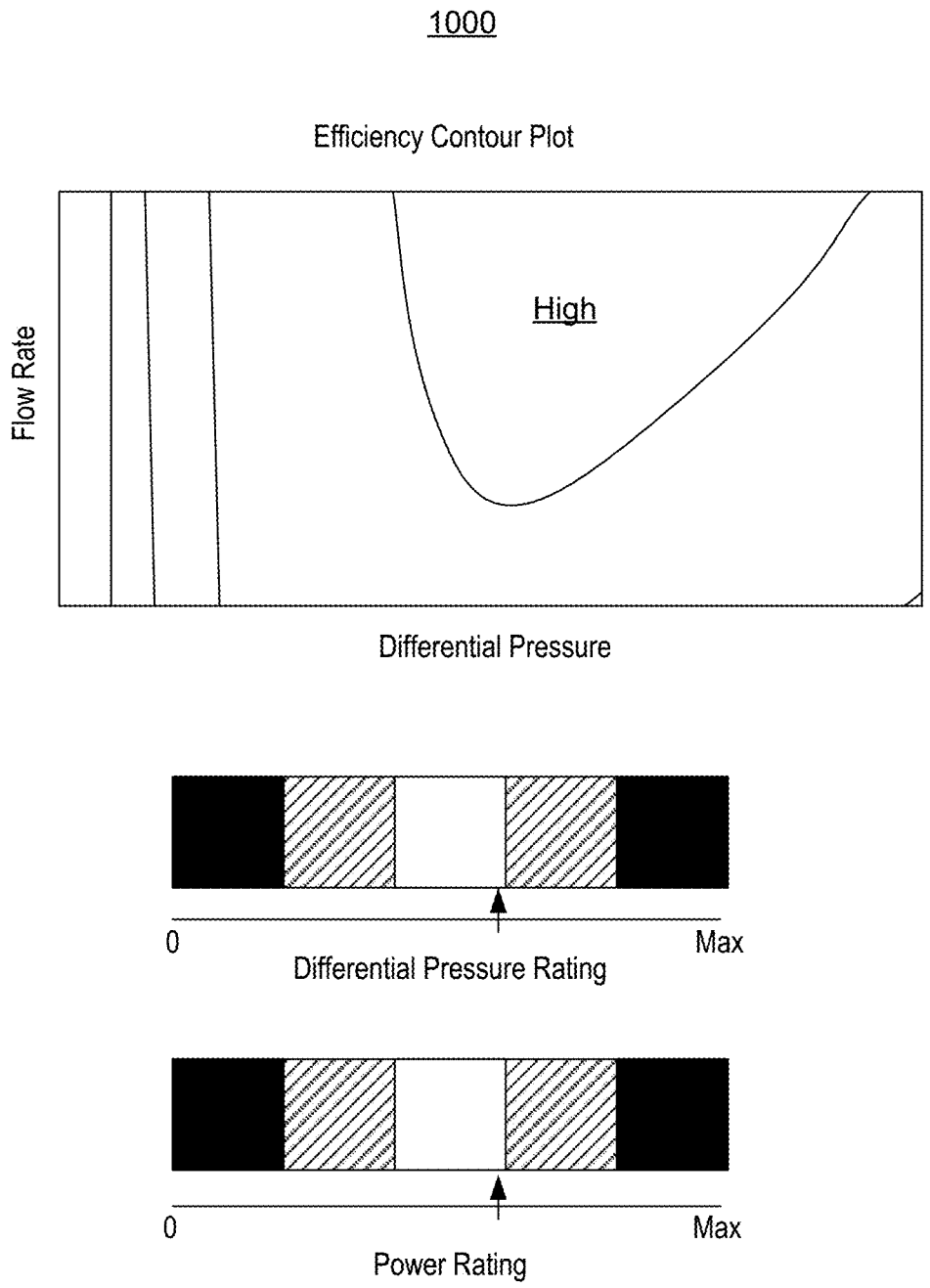
FIG. 10 shows an example of a process.

FIG. 10 shows an example of a process 1000 for exploration of parameter values, which may be part of a mutation process that aims to improve drilling while considering factors such as equipment wear, damage, etc. As shown, a mud motor may be quantified as to efficiency as a function of flow rate (FLWI) and differential pressure (DPRES). As shown, the process 1000 may include associated graphics, for example, to provide for assessment by one or more individuals, which may guide mutations, approve mutations, etc. For example, mutations may be generated using guidelines for differential pressure rating and/or for power rating, which may be specific to a selected mud motor or family of mud motors.

In the example of FIG. 10, the process 1000 may utilize data in the form of an efficiency contour plot where a mud motor may operate according to a differential pressure rating and a power rating within ranges that consider equipment safety (e.g., wear, etc.) along with efficiency, for example, to operate with high efficiency. As shown, operation of a mud motor may be explored with respect to ranges from 0 to maximum rating for one or more parameters of the mud motor.

Figure 11:
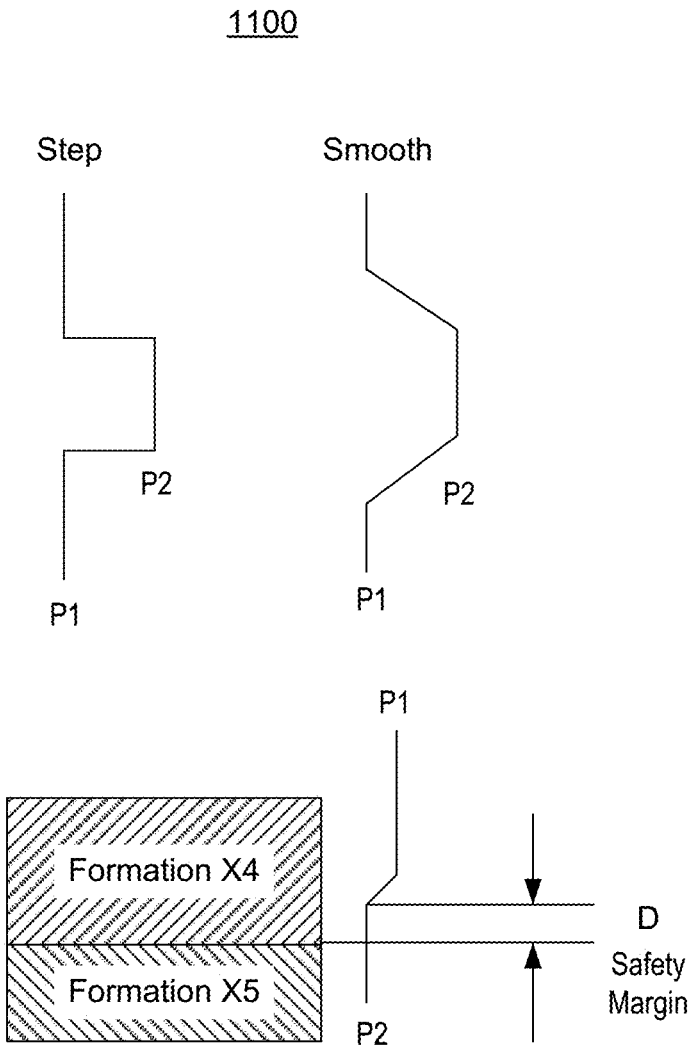
FIG. 11 shows examples of processes.

FIG. 11 shows examples of processes 1100 for adjusting one or more OOW parameter values, which may be in the form of a stepped transition (see step), a smoothed transition (see smooth), etc. As shown, a safety margin, D, may be utilized to ramp up or ramp down a parameter value based at least in part on one or more formation characteristics. As shown, a formation layer (formation X4) may be different from an adjacent formation layer (formation X5). As explained, a formation layer may be hard and abrasive (e.g., hard abrasive sandstone, etc.), which may give rise to increased drill bit wear. Increased drill bit wear may lead to NPT, for example, where a drill bit does not have enough life remaining to complete. As shown in FIG. 11, the process 1100 may implement one or more types of metrics to adjust a change in a parameter value or parameter values. For example, a parameter value may be ramped up or ramped down to address a change in type of formation. As explained, a framework may generate an OOW where the OOW accounts for formation types, changes, etc.

As explained, various techniques, processes, etc., may be utilized in generating one or more OOWs. As to data, a system may employ depth gating. In certain embodiments, defined depth gating techniques for dump channels may be utilized. In various instances, a dump channel may refer to a channel where data are stored in memory and then dumped (e.g., transferred, accessed, read, etc.). For example, a downhole tool may include memory where the memory may be read once the downhole tool is brought to a surface station. In such an example, the downhole tool may include features for real-time or near real-time transfers when downhole, though such transfers may be limited by bandwidth, transfer technique, conditions, etc. As an example, memory of a downhole tool may store an amount of data and/or one or more types of data that may not be available via downhole telemetry. As an example, depth gating may be utilized for one or more types of data and may be used on synchronized dump files.

As explained, surface data and dump data may be processed and aggregated. Such data may also be augmented with metadata, for example, to facilitate data searching and/or other processing. For example, consider metadata such as job number, location and offset, BHA, bit, operator, etc.

As explained, data may be used to determine one or more OOWs, which may be for certain tools and/or operations. An OOW may have a life cycle through multiple wells in the same field or basin. An OOW may thus evolve with accumulated drilling data and domain learning. An OOW may be used in execution to facilitate improved performance of wellsite operations. In certain embodiments, an OOW may be specific for a certain formation and hole size. As an example, an OOW may shift with the introduction of a new bit, a new tool and/or one or more changes in technologies. As such, an OOW may demand alignment or realignment during execution. As an example, an OOW may in the same field based on one or more differing priorities. For example, different operators may have different business models and/or requirements that may result in differing OOWs.

As explained with respect to FIG. 4, an OOW may be generated in a data-driven and domain-driven evolutionary manner (e.g., using mutations, etc.). In one embodiment, offset well statistics may be used to facilitate creation of an OOW. Offset well parameters channels may be depth gated, aligned by depth or formation tops, or otherwise prepared for use in generating an OOW. As an example, values such as mean, 25 percent, 75 percent, etc., may be computed in a moving window along a depth of a section. Values such as average and standard deviation of MSE, DMSE, S & V, and one or more others may be computed to gauge overall risk and formation variations. As an example, optional weights may be applied to different wells based on one or more factors such as, for example, one or more of distance, drilled time, BHA similarity, etc.

As explained with respect to FIG. 4, an OOW generation workflow may involve exploring with parameters values that may improve performance. For example, consider establishing a baseline by using offset well statistics. In one embodiment, a small step to a higher range value may be applied to one or more operating parameters. For example, if MSE and DMSE are relatively low, a relatively large incremental change may be used (e.g., P+ΔP, where ΔP is a step change in the parameter P). As an example, if MSE, DMSE, S & V are high, a smaller step up may be used. As an example, if a drill bit dull grade is severe or failure events are high, a smaller step or downwards steps may be used. Such an approach may be used to evolve the parameters and have the parameters migrate to more efficient ranges within a particular area. As an example, a migration (e.g., mutation) process may be stopped or reversed based on actual drilling performance.

As explained with respect to FIG. 10, mud motor efficiency may be affected by flow rate, differential pressure, and motor power section configuration. As an example, an OOW may be chosen to achieve good efficiency while working in an appropriate differential pressure range. For example, consider a mutation process that may include: If differential pressure is less than 25 percent of a recommended differential pressure limit of the power section, increase WOB and/or use WOB/DTOR ratio and power section specification to determine an appropriate WOB increment.

As an example, one or more techniques may be employed to account for bit life. For example, PDC bit damage may occur with wear due to hard and abrasive sandstone, impact damage in hard rock, impact damage in interbeds, and others. As an example, an OOW may be adjusted, for example: with lower RPM while drilling hard abrasive sandstone to reduce wear due to frictional heat; with appropriate WOB to avoid bit whirling (WOB too low, RPM too high) or cutter overloading (WOB too high); avoid aggressive parameters drilling interbeds; if the whole section has high impact intensity, use less aggressive WOB/RPM (reduce proportionally with impact intensity factor); etc.

As an example, an evolutionary approach may be used in connection with RSS directional performance. For example, a directional behavior trend may be obtained from drilling data and an OOW may be adjusted, for example, by: If DLS<DLS_norm (e.g., where DLS achieved by a BHA is less than normally expected DLS based on drilling data), adjust one or more of WOB, ROP and RPM to improve DLS based on the lessons learned from drilling data; and CRPM max (e.g., max RPM expected for an RSS tool) to be within a tool limit: 2×SPRM+RPM_motor<350.

As an example, an OOW objective priority may be considered. For example, when adjusting parameters for an OOW, objectives may have different priorities. For example, when drilling a curve with marginal DLS capability, it may be desirable to adjust and select parameters to meet a DLS requirement. Adjusted parameters may be locked in such circumstances following adjustment unless higher risks are identified. In certain embodiments, the adjustment may be performed selectively based on applications, such as risk tolerance, operator preference, business models, common failure events, etc.

As explained, an OOW generation workflow may employ mutation as an evolutionary technique. For example, with substantial changes of drill bit, mud motor, RSS tool, drill pipe, or other subsystems or drilling practices for a new job, a mutation may be introduced to the OOW evolution process. In such circumstances, the OOW starting curves may be shifted based on historical data from offset wells. Physical modeling, simulation, and/or domain knowledge may be leveraged to reform the starting curves allowing the OOW logic to be selectively applied. For example, if a more powerful motor is introduced with a higher torque limit, an OOW may have access to a higher WOB. As an example, an increment may be based on WOB/DTOR relationship from historical data and/or a product specification (e.g., product label, manual, spec sheet, etc.).

As an example, an OOW workflow may involve offset well alignment. For example, offset wells may be aligned on depth (e.g., when formation is relatively uniform in the application), depth and trajectory (e.g., when a trajectory profile is to be considered), formation logs (e.g., gamma), or MSE (e.g., when gamma is available or MSE has a clear signature), and/or depth stretch and compression, intelligent depth alignment when, for example, formation tops vary in depth. As an example, alignment may be performed automatically, manually and/or semi-automatically.

In one example, when depth of formation tops varies, alignment of formation tops may demand special treatment. One approach may be to map out the formation tops using offset wells and predict formation tops of targeted wells based on the map. As an example, offset well statistics may be obtained using normalized formation depths mapped to the targeted well. In such an example, an OOW may then be adjusted based on appropriate logic. As an example, an OOW may be actively aligned during execution based on the actual formation tops (e.g., per sensed information by one or more sensors, whether at surface and/or downhole).

As an example, an OOW workflow may account for composition changes, such as hard stringers and interbeds. In one embodiment, a strategy may involve parameter changes with gradual transition, safe zones for hard stringers, and/or parameter taper up or down near stringers. As explained with respect to FIG. 11, various types of ramping may be utilized. For example, where there are many stringers with high UCS contrasts, particularly those combined with high S & V, frequent bit damage, tool damage, etc., less aggressive drilling parameters may be planned for OOW.

As an example, an OOW may be available in one or more of a variety of formats. In one embodiment, hard copies of OOW charts may be generated and provided to the wellsite teams. As explained, an OOW may be generated in digital form, which may be suitable for use as part of a digital drilling program that includes parameters to be used during the automatic execution of portions of the drilling program. As an example, an OOW may be a set of autodriller setpoints and limits (e.g., optionally including tuning parameter values, etc.). As an example, at each depth, an automated approach may include using OOW parameter window min/max for autodriller limits, for example, using a median, an OOW parameter recommendation, etc., as a setpoint.

As an example, an OOW generation workflow may provide for consideration of OOW as to shock and vibration mitigation starting from a selected well, as to shock and vibration mitigation starting from one or more dominant shock and vibration modes of offset wells, etc.

Figure 12:
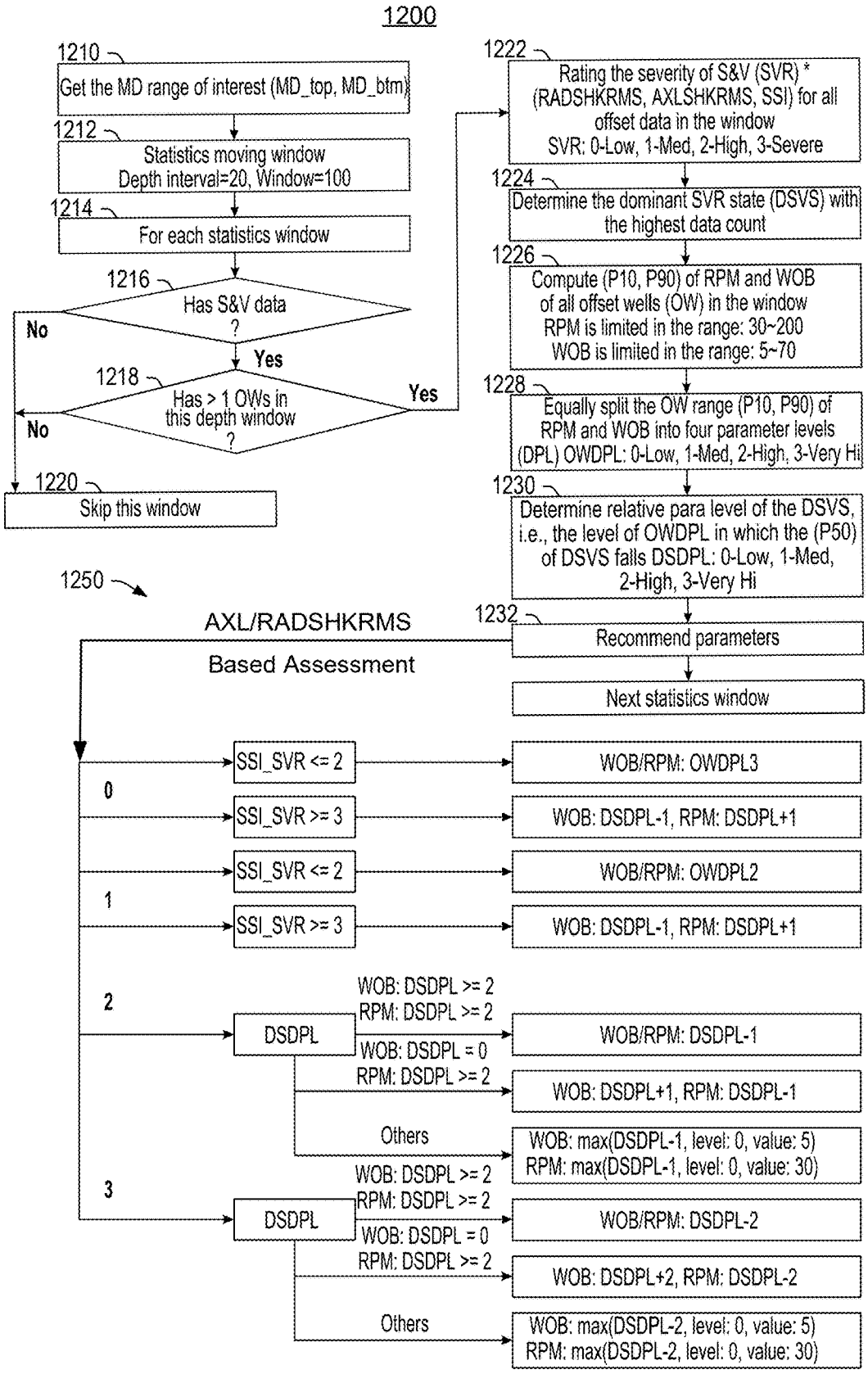
FIG. 12 shows an example of a workflow.

FIG. 12 shows an example of a workflow 1200 for shock and vibration mitigation starting from one or more dominant shock and vibration modes of offset wells; noting that the workflow 1200 may be adjusted, modified, etc., for one or more other types of considerations, additionally, alternatively, etc.

In the example of FIG. 12 OOW is the optimal operation window, OW is offset well, SVR is shock & vibration rating, OWDPL is offset well drilling parameter level, DSDPL is dominant S & V state drilling parameter level, DSVS is dominant S & V state, SSI is stick slip index, AXLSHKRMS is axial shock RMS, and RADSHKRMS is radial shock RMS.

As shown, the workflow 1200 may include a reception block 1210 for receiving a MD range of interest, a computation block 1212 for statistics in a moving window for a depth interval, an iteration block 1214 for assessing each statistics window to determine, per a decision block 1216, whether S & V data are available and, per another decision block 1218, whether there is more than one offset well in the depth window (e.g., data from more than one offset well (OW) available). As shown, per "no" branches, the workflow 1200 may skip a window, as per block 1220, while, per "yes" branches, the workflow 1200 may proceed.

As shown, the workflow 1200 may proceed to a rating block 1222 for rating of severity of S & V for offset well data in the window, according to a rating system with SVR values of 0 as low, 1 as medium, 2 as high and 3 as severe. In such an example, a determination block 1224 may determine the dominant SVR state (DSVS) with the highest data count. In a computation block 1226, various statistics may be computed (e.g., P10, P90, etc.) of operational parameters such as, for example, RPM and WOB in the offset wells in the window where RPM may be limited in a range and where WOB may be limited in a range. In a splitting block 1228, the workflow 1200 may equally split the offset well range (e.g., P10, P90) of RPM and WOB into four parameter levels (DPLs), which may be denoted OWDPLs of 0 for low, 1 for medium, 2 for high and 3 for very high. Next, the workflow 1200 may proceed to another determination block 1230 for determining relative parameter level of the DSVS, which may be the level of OWDPL in which the P50 of DSVS falls, which may be denoted DSDL of 0 for low, 1 for medium, 2 for high and 3 for very high.

As shown, the workflow 1200 may proceed to a recommendation block 1232 for recommendation of parameters, which may be based on a process 1250 that assesses axial SHK RMS (AXLSHKRMS) and radial SHK RMS (RADSHKRMS). As shown, values may be assessed for DSDPL and SVR as to dominant S & V state (DSVS). In such an approach, the process 1250 may provide for output of appropriate values for WOB and RPM for the particular window, where the values may be part of an OOW.

Figure 13:
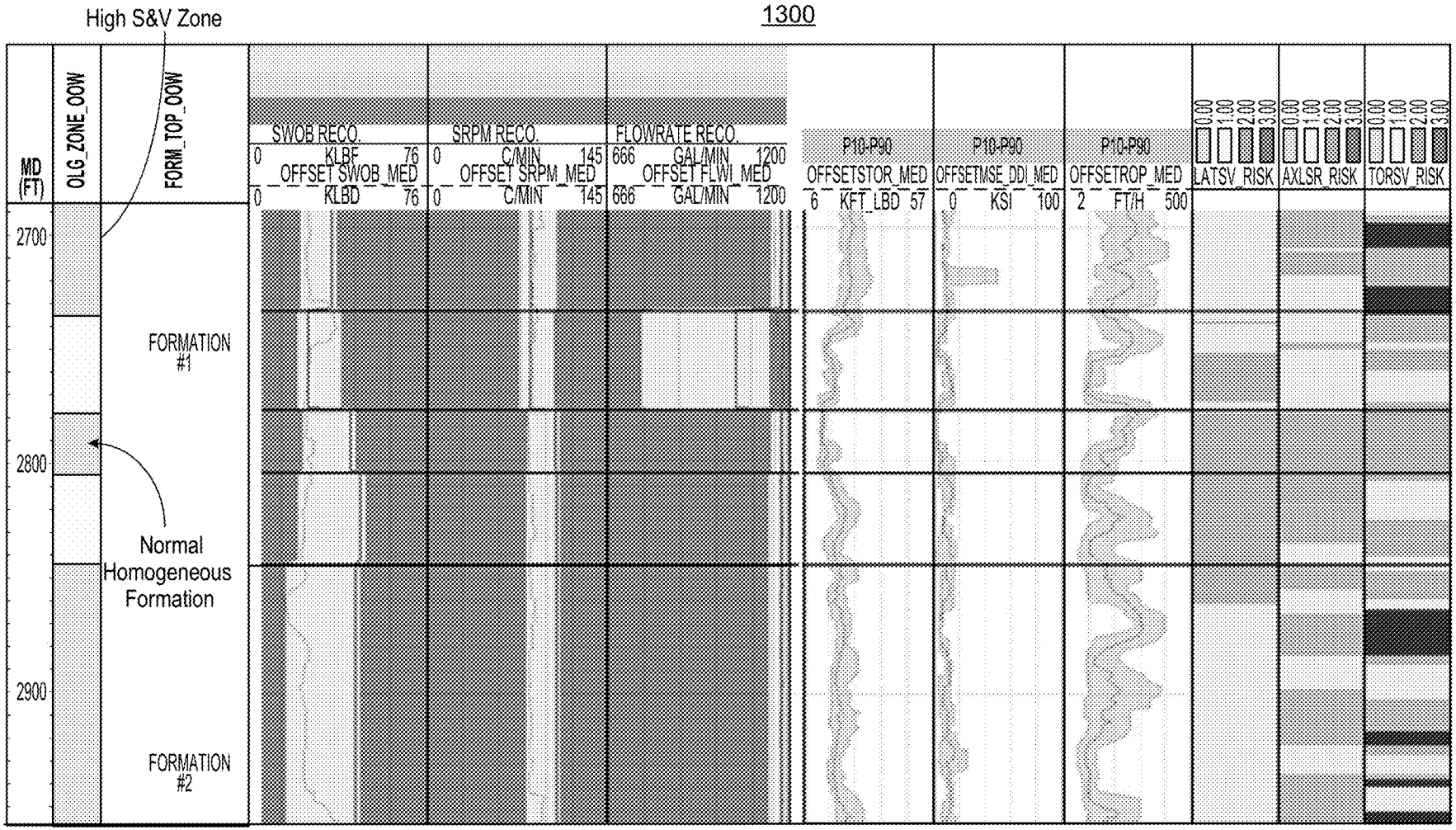
FIG. 13 shows an example of a graphical user interface (GUI)

FIG. 13 shows an example graphical user interface (GUI) 1300 of output from an OOW workflow as generated using offset well data. The GUI 1300 may include various graphical indicators such as shading, colors, etc. For example, consider color coding of green zones with blue lines for recommended parameters, along with yell zones based on P10 and P90 statistics or other statistics, or, for example, one or more user defined statistics, limits, etc. In the example GUI 1300, output may be referenced to various zones such as a high S & V zone (HSV), a normal homogenous formation zone (NF), etc.

Figure 14:
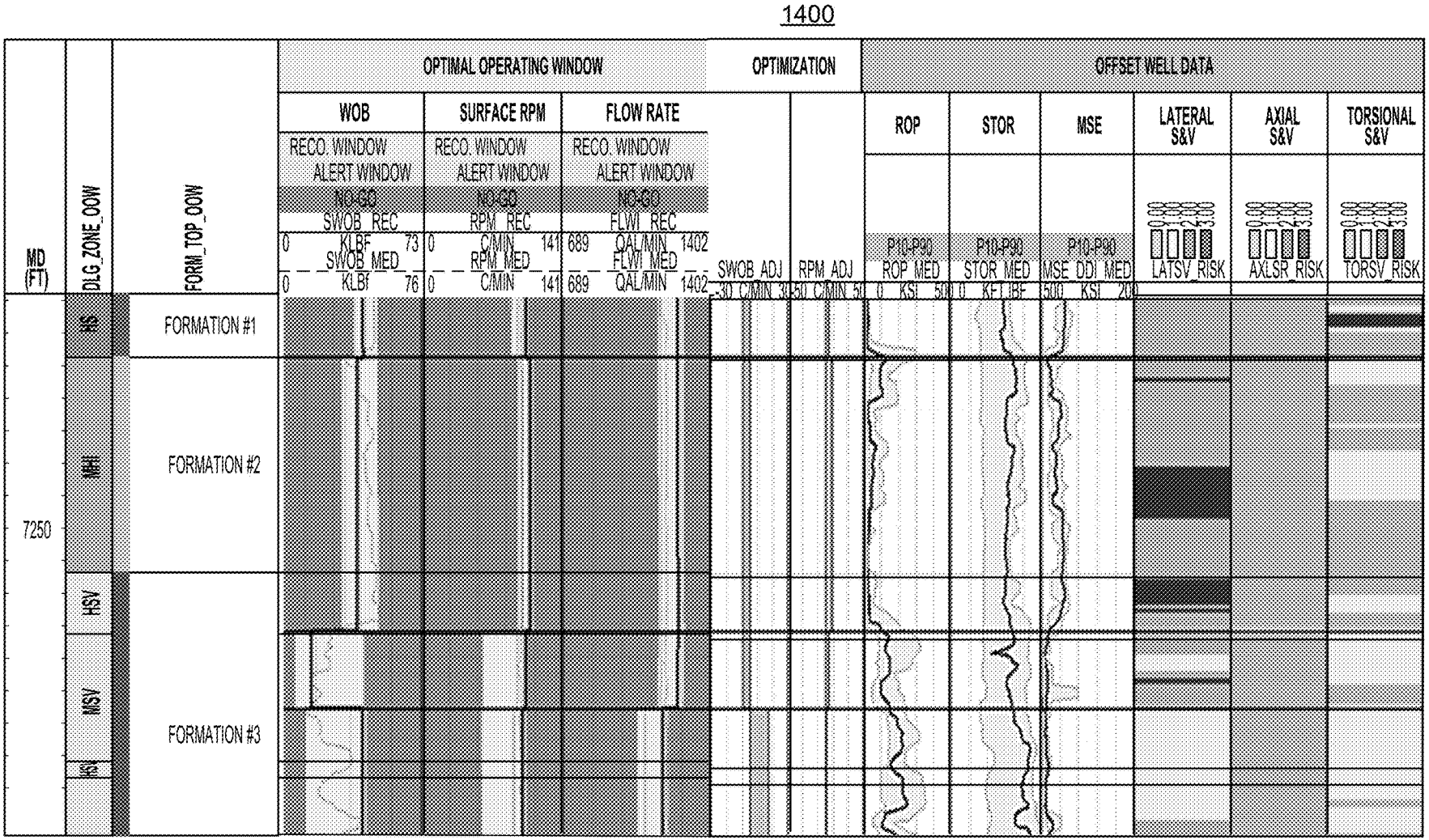
FIG. 14 shows an example of a graphical user interface (GUI)

FIG. 14 shows an example graphical user interface (GUI) 1400 of output from an OOW workflow as generated using offset well data as mapped to a target well. The GUI 1400 may include various graphical indicators such as shading, colors, etc. For example, consider color coding of green zones with blue lines for recommended parameters, along with yell zones based on P10 and P90 statistics or other statistics, or, for example, one or more user defined statistics, etc. In the example GUI 1400, output may be referenced to various zones such as a high S & V zone (HSV), a normal homogenous formation zone (NF), etc. As an example, the content in the GUI 1400 may be output in digital form, which may be utilized, for example, to control operations for drilling of the target well.

Figure 15:
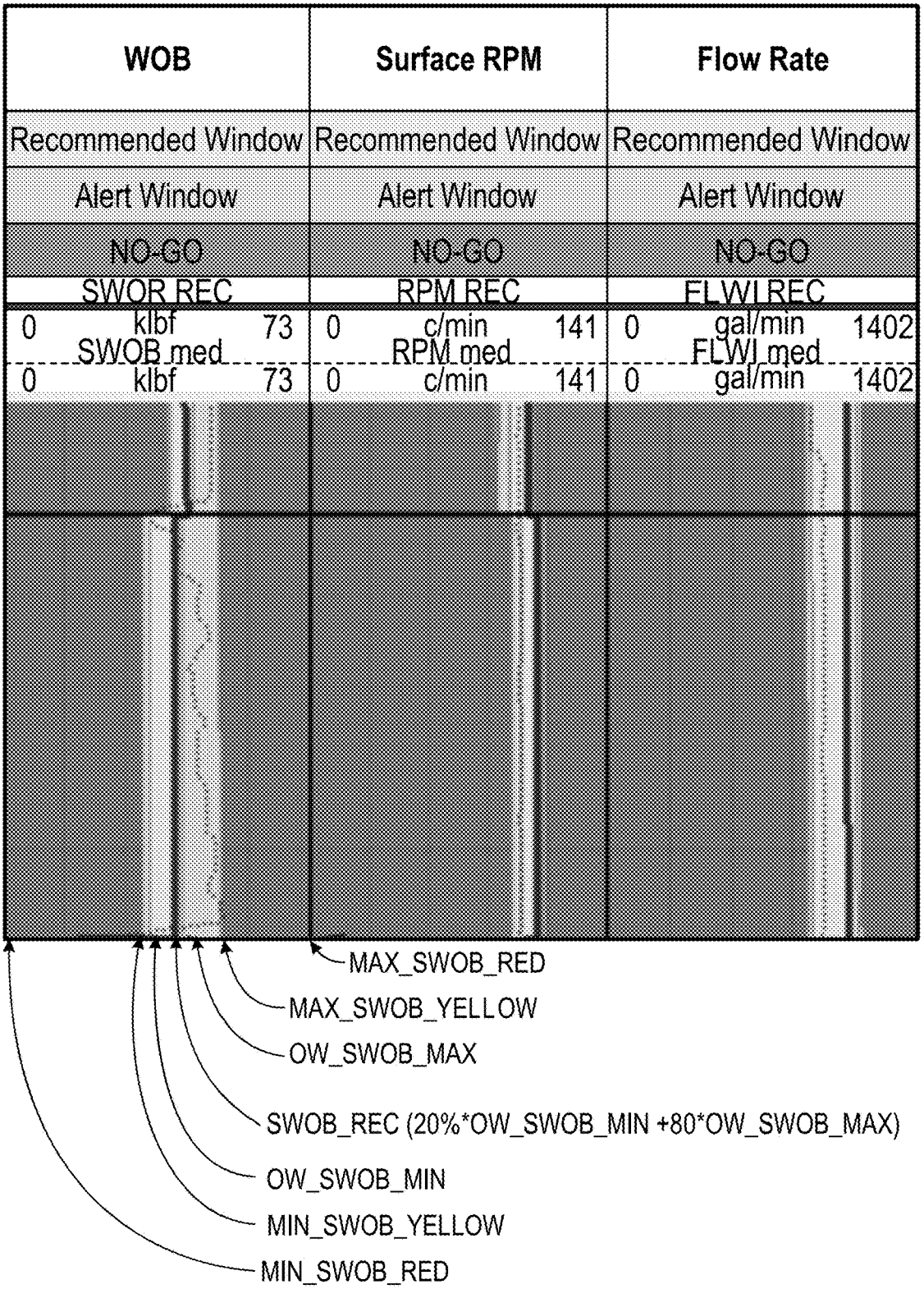
FIG. 15 shows an example of a graphical user interface (GUI)

FIG. 15 shows an example graphical user interface (GUI) 1500 of output from an OOW workflow as generated with particular coding that may help to guide a user and/or a machine in performing one or more field operations.

Figure 16:
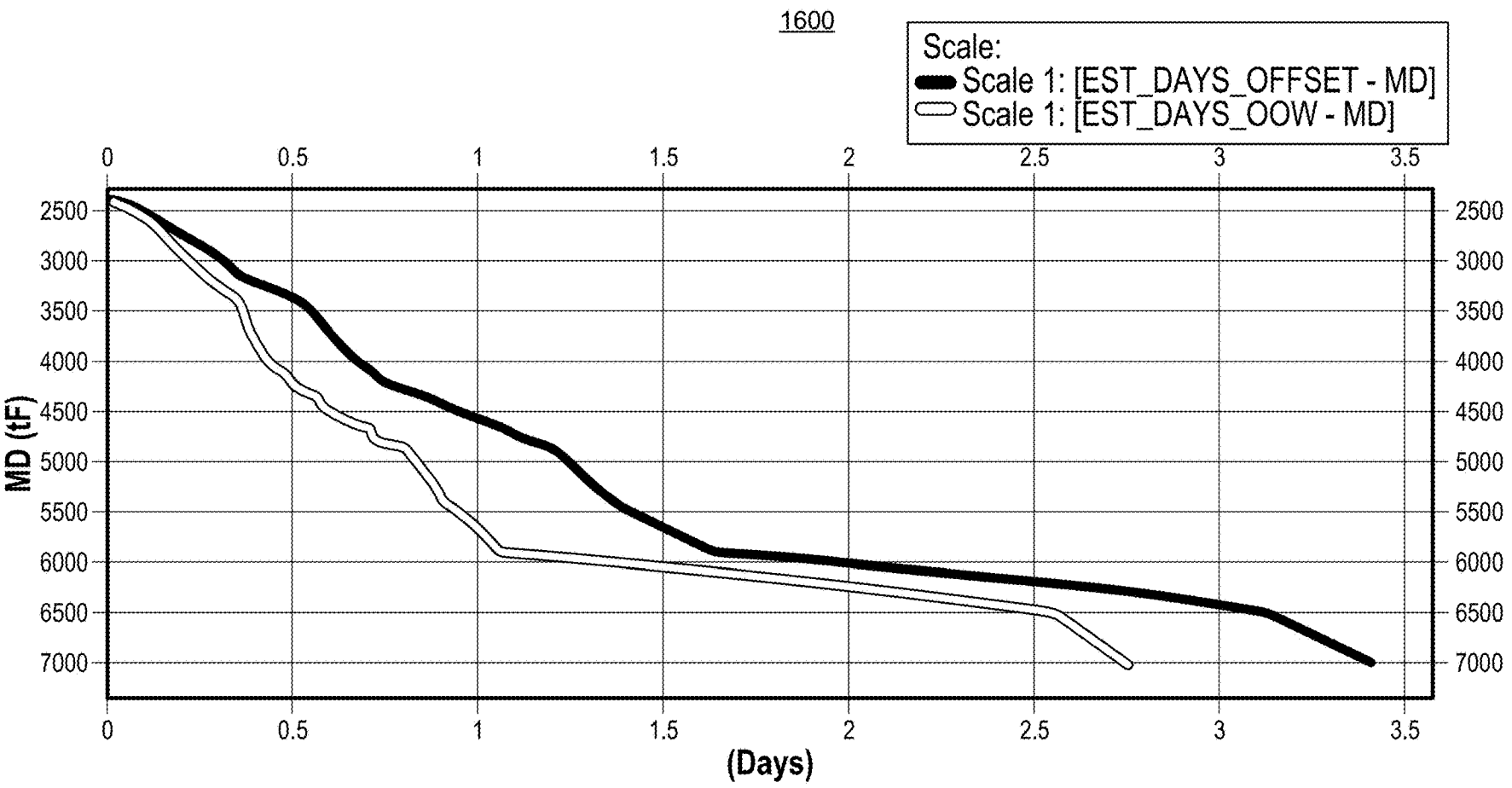
FIG. 16 shows an example of a graphical user interface (GUI)

FIG. 16 shows an example graphical user interface (GUI) 1600 for synthetic day versus depth curve where, for example, a system may estimate the drilling time (e.g., without the flat time) to demonstrate the efficiency gain through a generated OOW.

Figure 17:
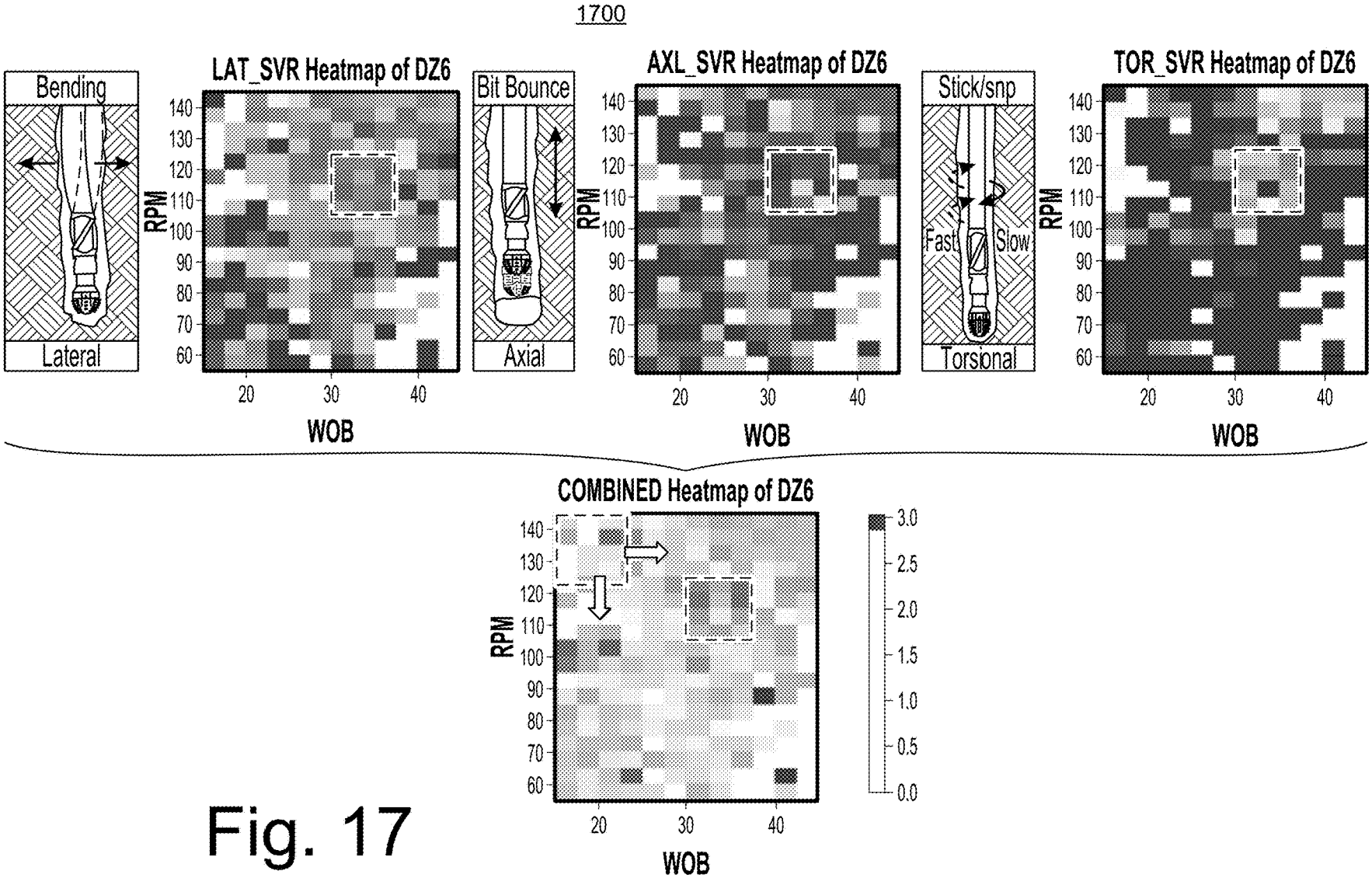
FIG. 17 shows an example of a graphical user interface (GUI)

FIG. 17 shows an example graphical user interface (GUI) 1700 for an approach that may provide for a stable operating window search using one or more S & V heatmaps for generation of an OOW for a particular zone and/or section in a particular well, labeled DZ6 (e.g., a target well). In the example of FIG. 17, the response surface of S & V with respect to parameters (e.g., taken from offset data, from mutations and simulations, etc.) may be assessed, for example, to determine normalized S & V risk level, where a stacking of response surfaces (e.g., combining response surfaces) may build an overall S & V risk heatmap. As shown, a method may include searching for a stable operating window that, for example, aims to minimize one or more types of risk. While S & V information are shown in the GUI 1700, a heatmap and search-based approach may be applied to one or more other types of behaviors (e.g., ROP, MSE, etc.) and/or one or more other types of risk.

As shown in the example of FIG. 17, the GUI 1700 may provide for assessing one or more types of risk, which may include, for example, drillstring and formation interaction risks. For example, consider a bending risk for bending of a drillstring in a borehole, a bit bounce risk for bouncing of a drillstring in a borehole, and a slip stick risk of a drillstring sticking and/or slipping in a borehole. As explained, a workflow for generating an OOW may account for various types of risk, which may be utilized in arriving at optimal operational parameter values. For example, an optimization technique may include optimizing parameter values in a mutation-based manner whereby drilling may be optimized (e.g., increased ROP, etc.) with acceptable risk. In the GUI 1700, the heatmaps indicate S & V information associated with particular risks with respect to operational parameters of RPM and WOB, noting that one or more other types of operational parameters may be utilized in combination with such heatmaps and/or risk, and/or one or more other types of heatmaps and/or risks.

Figure 18:
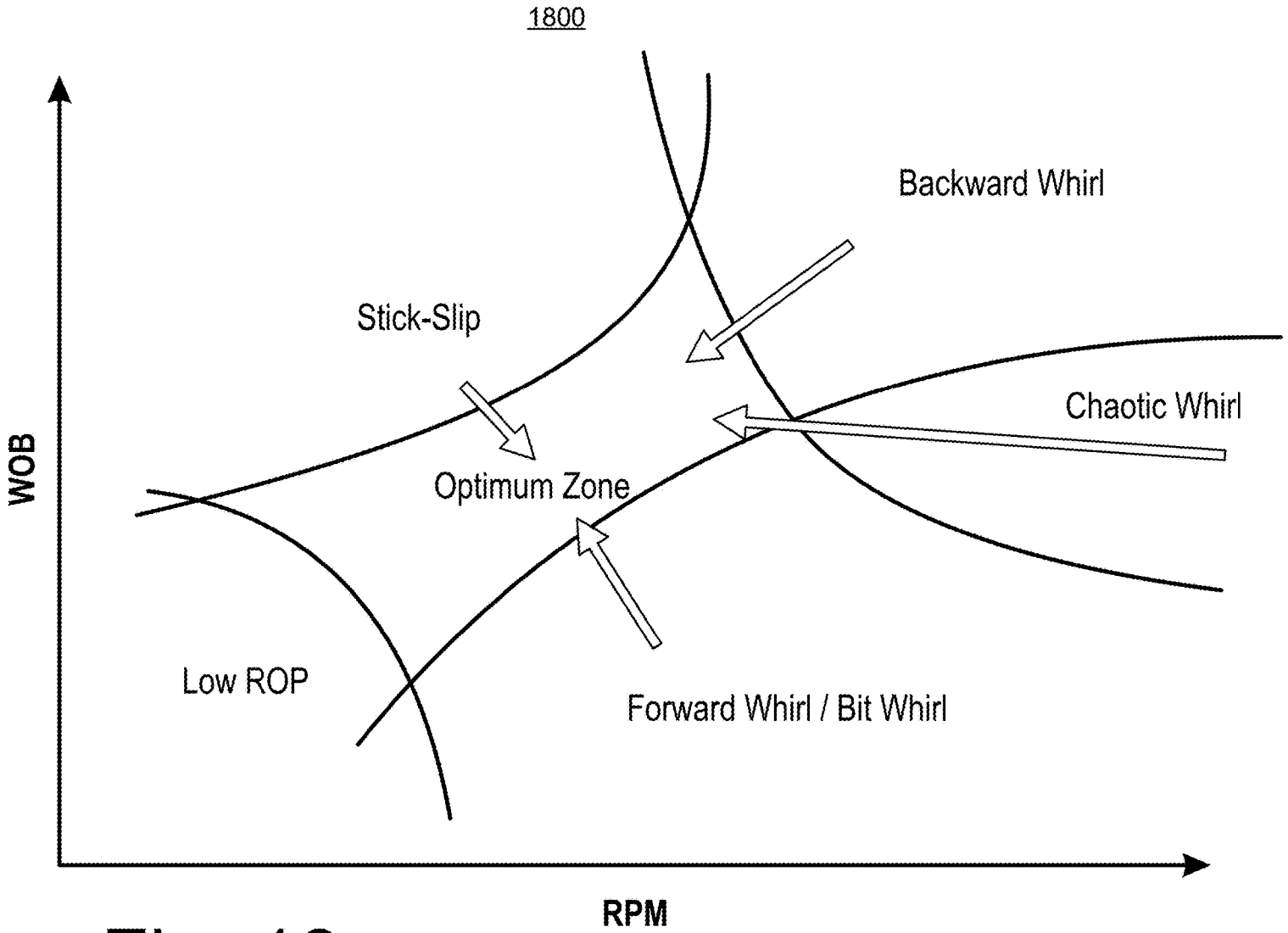
FIG. 18 shows an example of a graphical user interface (GUI)

FIG. 18 shows an example of a graphical user interface (GUI) 1800 that may provide for mitigation of S & V, for example, based on domain knowledge. As shown in the example of FIG. 18, factors such as stick slip, whirl, ROP, etc., may be taken into account to help identify an optimum zone with respect to parameters such as WOB and RPM. In the example GUI 1800, one or more factors may be risk factors, for example, one or more types of behaviors that pose risks during drilling operations. For example, chaotic whirl may be a type of behavior that poses a risk to a drillstring in a borehole, which may impact integrity of the drillstring and/or the quality of the borehole. In various instances, behavior may damage or excessively wear a drill bit, which may impact an ability to complete a section or sections of a borehole. As explained, where a drill bit wears or is otherwise damage prematurely such that replacement is required, non-productive time (NPT) may be introduced, which may impact overall ROP, time to completion, resource demand for drilling, etc.

Figure 19:
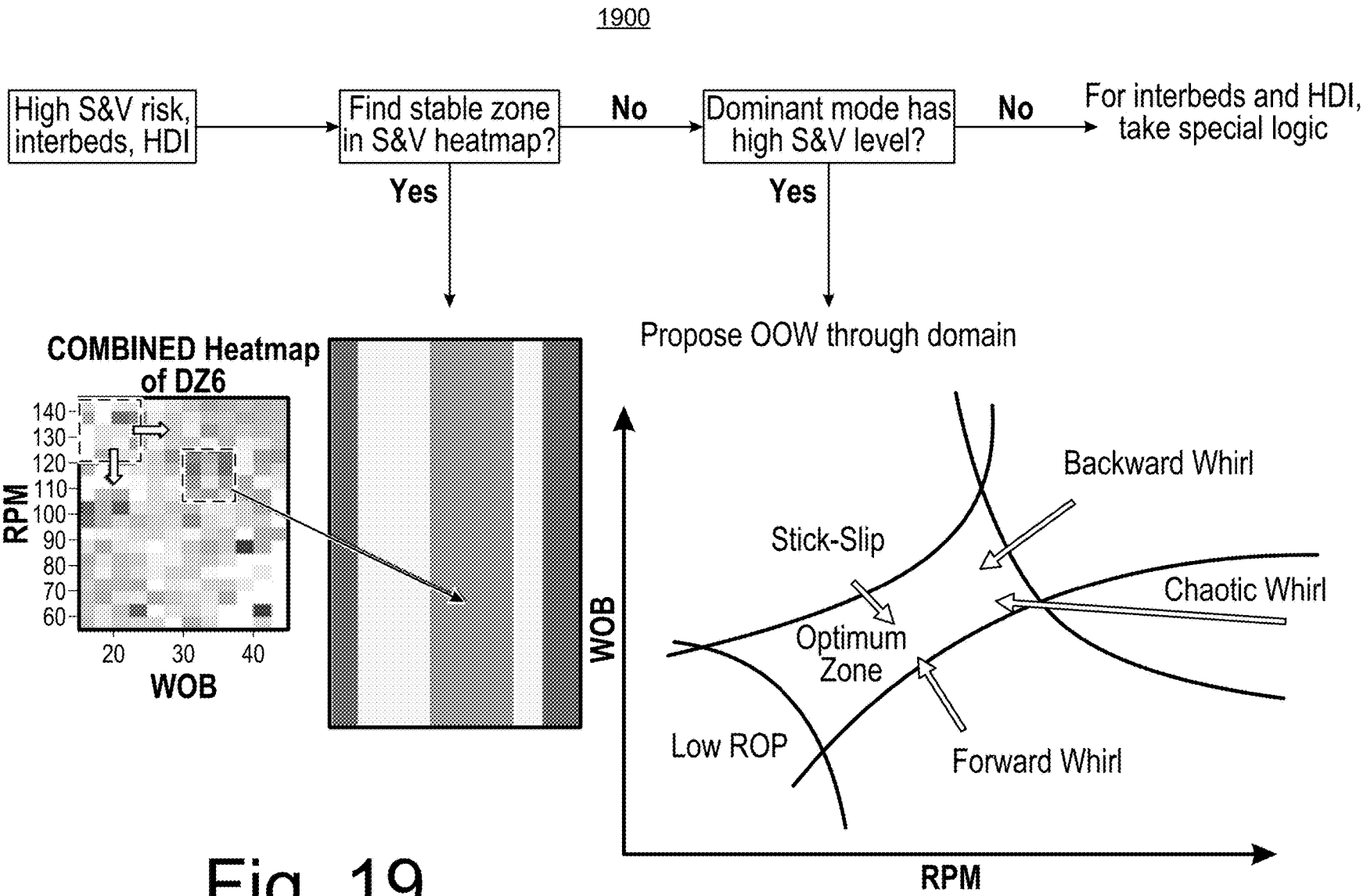
FIG. 19 shows an example of a workflow.

FIG. 19 shows an example of a process 1900 that may provide for determining an OOW location for a high-risk formation (e.g., a high-risk zone, etc.). The process 1900 may integrate heatmaps, domain knowledge, etc. The process 1900 may include one or more decision blocks that may decide, for example, whether it is possible to find a stable zone in an S & V heatmap and, if not, whether a dominant mode has a high S & V level, where, if so, an OOW may be generated at least in part via domain knowledge. As shown, the process 1900 may provide that interbeds and HDIs are handled using special logic.

Figure 20:
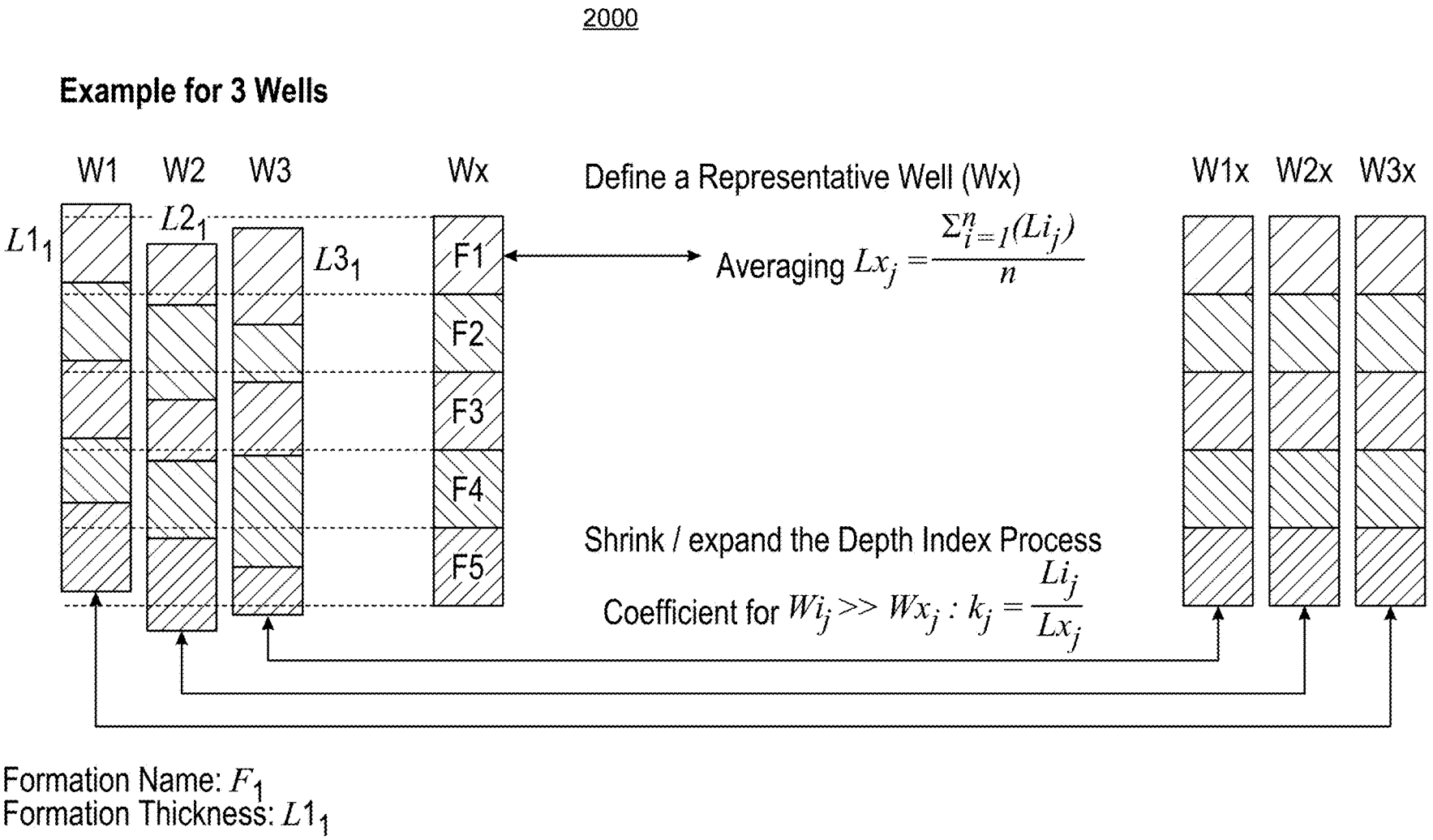
FIG. 20 shows an example of a process.

FIG. 20 shows an example of a process 2000 for an OOW generation workflow. As shown, for three wells, formation names and formation thicknesses may be taken into account, for example, to harmonize data from the three wells, which may be offset wells as defined with respect to a target well. The process 2000 of FIG. 20 may be referred to as formation alignment, as depths (e.g., measured depths (MD)) of data are aligned for purposes of OOW generating.

Figure 21:
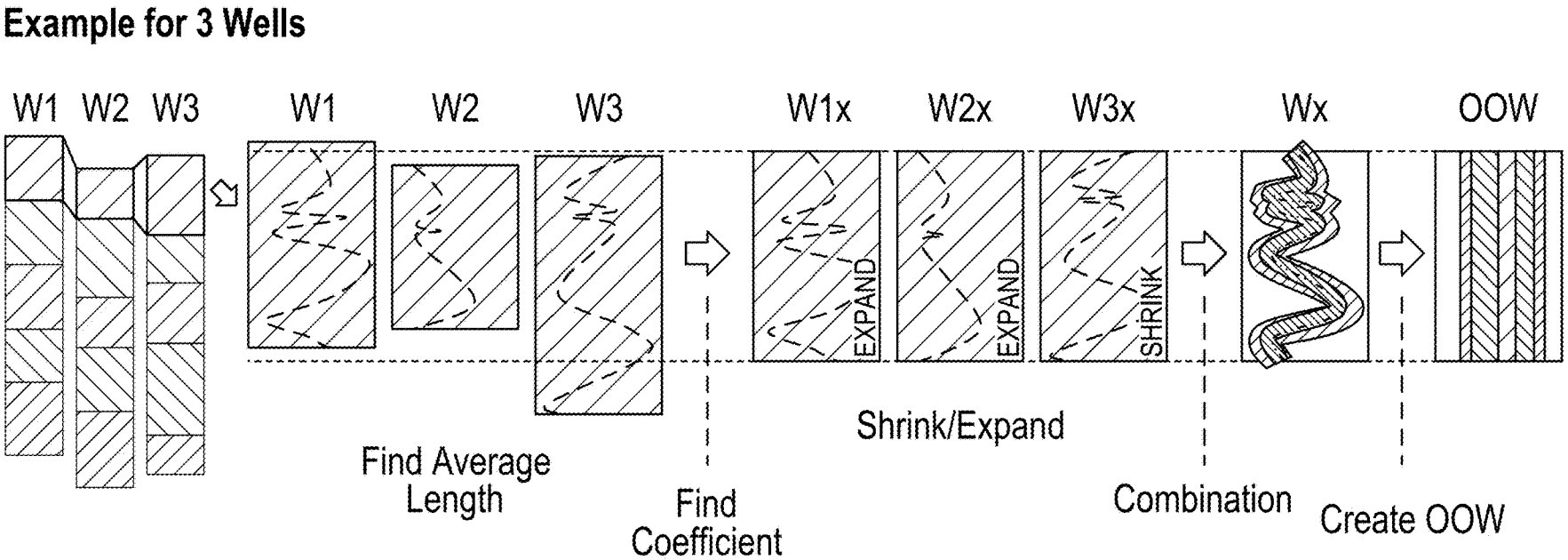
FIG. 21 shows an example of a process.

FIG. 21 shows an example of a process 2100 for an OOW generation workflow. As shown, the process 2100 may be part of the process 2000 for the three wells. For example, the process 2100 may include finding an average length, finding a coefficient, shrinking or expanding information for one or more of the wells, combining information from the wells and generating an OOW.

As an example, the process 2000 and/or the process 2100 may include determining an average length of a formation (j) for a representative well (x) based on its length from selected wells (i) (n=number of wells):

$$Lx_j = \frac{\sum_{i=1}^{n}(Li_j)}{n}$$

In such an example, a coefficient may be determined for each well per each formation:

$$ki_j = \frac{Li_j}{Lx_j}$$

Given such a coefficient, a decision may be made to shrink (if the coefficient $k_j>1$) or expand datapoints (e.g., the depth index) per each formation equally.

As to formation top alignment, each formation top can present one or more characteristics in terms of geology and/or drilling dynamics (e.g., ROP, S & V, steering, etc.) response. As explained, to define drilling parameters for a portion of a well or section, a process may include segregating the well or section into smaller segmentations, which may be at least at formation top level. As explained, in using data from multiple offset wells, the data may be grouped into formation tops and defined with respect to a representative depth. In various instances, a process may aim to standardize (e.g., harmonize) formation tops names and sequences such that common metadata may be utilized to expedite processing.

As an example, a workflow may include alignment of data followed by statistical processing, which may aim to combine statistical results (e.g., P0 to P100) for selected wells along a depth interval for a list of channels (e.g., data channels). As an example, where formation tops are unavailable for selected wells, statistical processing may occur without formation top alignment; noting that output accuracy may be lesser than with formation top alignment. As an example, one or more other alignment techniques may be implemented, for example, consider drilling zone alignment, which may be available from a framework such as the TECHLOG framework (e.g., consider use of drilling similarity index, etc.).

As explained, after processing per depth interval (e.g., each 0.5 ft in MD or another appropriate incremental value), data may be smoothened and filled over a larger span such as, for example, a 10 ft moving window. If drilling zones are utilized (e.g., for thick formation tops or unavailable formation tops), an entire interval may be split into sub-layers for representing a response of drilling dynamics. As an example, a workflow may proceed through each formation top and/or drilling zone and compute the mean for each OOW channel (e.g., FLWI, WOB and RPM), which may present as a straight line or a stepped line, optionally with ramping up and/or ramping down. As explained, shock and vibration channels may be combined into classes, modes or states, such as, for example, lateral, axial and torsional modes. Based on comparing measurements to thresholds, a workflow may define severity level of each S & V state where, for example, level 3 for lateral mode is the highest. As an example, an adjustment for an OOW may be applied based on a mitigation process.

As mentioned, drilling zones may be utilized. For example, where formation tops may be unavailability for offset runs or where a formation top may be thick and cover a number of sub-layers that cause different drilling dynamics and different drilling parameters to drill the sub-layers efficiently, a workflow may divide the drilling interval, for example, thick formation tops into thinner drilling zones. As an example, inside each drilling zone, drilling dynamics and parameters may be expected to be one of following: homogeneous or heterogeneous. If homogeneous, there may be a linear response between drilling parameters and performance and S & V, hence, a workflow may aim to maximize values of the drilling parameters. In contrast, if heterogeneous, prevention and mitigation may be applied, for example, using domain knowledge and/or a data-driven approach.

As an example, a reference channel or a number of reference channels may be utilized to define one or more change points. From set of change points, a workflow may label drilling zones (e.g., based on formation unconfined compressive strength, DMSE, formation strength, etc.). Drilling zones may be classified, for example, as homogenous, hard-stringer, and/or interbedded. In such an approach, where hard-stringer, interbedded may be considered as sub-type of heterogeneous.

As an example, a reference channel may be formation unconfined compressive strength (UCS) or confined compressive strength (CCS, which is UCS with differential pressure between borehole and pore pressure); noting that one or more other channels may serve as a reference channel or reference channels, additionally or alternatively. For example, consider one or more of MSE, formation strength (e.g., stiffness), formation gamma ray, formation density, etc.

As to DMSE, it may be used as a reference channel, for example, as a proxy of formations and sub-formations. As an example, DMSE may be available in offset well data, for example, as computed real-time using the OPTIDRILL framework (SLB, Houston, Texas). As an example, DMSE may be computed as follows:

$$DMSE = \frac{4 \times WOB_{surf}}{\pi \times D^2} + \frac{480 \times (K_t \times \Delta P) \times (RPM_{Surf} + K_n \times Q)}{D^2 \times ROP}.$$

Or, where a BHA does not Include a Mud Motor:

$$DMSE = \frac{4 \times WOB_{bit}}{\pi \times D^2} + \frac{480 \times TOR_{bit} \times RPM_{bit}}{D^2 \times ROP}$$

where:

MSE Mechanical Specific Energy (psi)
$WOB_{surf}$ Weight on bit at surface (lbf)
$RPM_{surf}$ Rotary Speed at surface (rev/min)
$TOR_{surf}$ Torque at surface (ft-lbf)
ROP Penetration rate (ft/hr)
D Bit Diameter (in)
ΔP Differential pressure (psi)
Q Mud flow rate (GPM)
$K_t$ Motor torque factor (ft.lbf/psi)
$K_n$ Motor speed factor (rev/GPM)
$WOB_{bit}$ Weight on bit at surface (lbf)
$RPM_{bit}$ Rotary Speed at surface (rev/min)
$TOR_{bit}$ Torque at surface (ft-lbf)

As to formation strength (e.g., stiffness), it may be considered to reduce influence of high fluctuation of torque input due to high probability of torsional vibration (e.g., in stick and slip form) in various operations. For example, consider utilization of depth of cut (DOC) in inches per revolution and/or formation strength in psi as follows:

$$DOC = \frac{ROP}{5 \times RPM_{bit}}$$

$$FORSF = \frac{WOB_{bit}}{DOC \times D}$$

As to formation gamma ray it may be measured using one or more types of tools (e.g., MWD, LWD, RSS, etc.), which may fairly indicate a change in formation lithology. As an example, formation gamma ray may be utilized in combination with one or more other factors to enhance determinations that may differentiate rock hardness, which may contribute to drilling performance and dynamics.

As to formation density, it may be measured by an LWD tool (e.g., consider the ADNVISION tool and/or the ECOSCOPE tool (SLB, Houston, Texas)). Formation density may be available in one or more sections, which may include a production section of an offset well.

Figure 22:
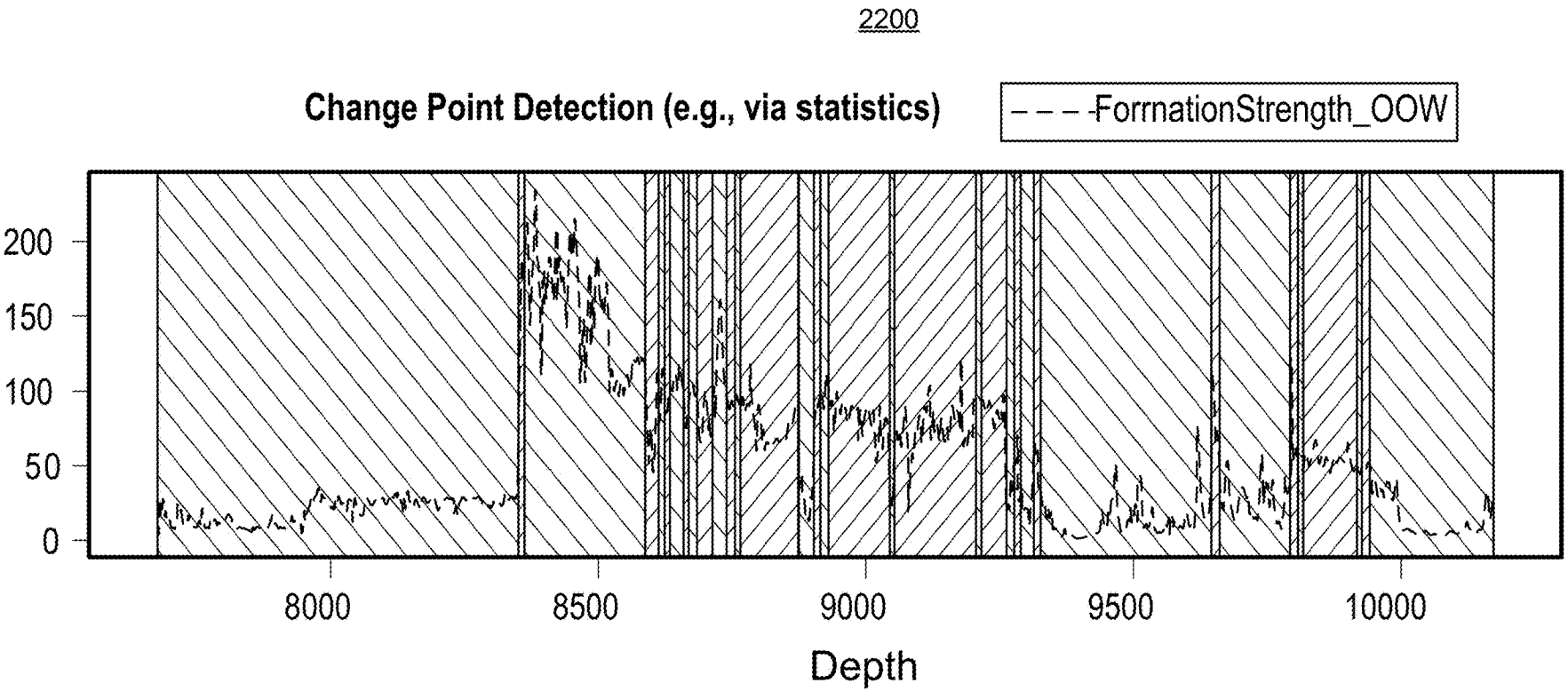
FIG. 22 shows an example of a graphical user interface (GUI)

FIG. 22 shows an example of a graphical user interface 2200 for change point detection (CPD). Such an approach may be statistics based where the change points may be detected at various depths (e.g., MDs) using statistics. Such an approach may be implemented to assess and/or to determine OOWs, for example, when to change an OOW.

As an example, one or more CPD techniques may be implemented, which may include one or more of online and offline approaches. For example, an online CPD approach may utilize real-time data such as, for example, streaming time series data, to detect one or more changes, which may include one or more anomaly events; and, an offline CPD approach may include use of an amount of time series data that may be sufficient to perform one or more statistical analyses, one or more physics-based models and/or one or more data-driven models.

As an example, a statistical analysis may utilize a feature (e.g., a reference channel) as input where, for example, a histogram for this feature may be generated based on pre-defined number of bins which is subjected to optimization.

As an example, consider defining a range of changes that focuses on one or more distributions and that may aim to reduce time complexity. In such an example, a lower limit for percentage of data points may be set. For example, consider use of DMSE and setting a lower limit (zone_threshold)=0.05 (5 percent) where a range of changes may be computed; whereas, if a lower limit=0.01 (1 percent) then a different range of changes may be computed. While DMSE is mentioned, formation strength and/or one or more other metrics may be utilized.

As an example, one or more of minimum interval (integer) as minimum drilling interval that allows to split into smaller drilling zones; moving window (integer) as depth interval for moving window; clean window (integer) as depth interval for cleaning spike; and zone quantile (float) as to compute a value within a zone that compares with a threshold (e.g., a higher number being more sensitive to spike (noise) and a lower number, less sensitive) may be used.

As explained, OOW generation may include mutation-based optimization. For example, consider optimization that considers one or more of S & V, ROP and steerability. In such an example, depending on location (e.g., contractual obligation, equipment availability, etc.), an operational team may decide to target one or more objectives such as, for example, maximize ROP with no, or less consideration for S & V, optimize ROP with consideration for S & V, optimize ROP for steerability, optimize ROP for hole stability, etc. As explained, parameter values may be explored via a mutation-based process in an effort to meet one or more objectives.

As explained, an OOW approach may have a life cycle through multiple wells in the same field or basin. As example, a system may provide OOWs that evolve with accumulated drilling data and domain learning. In various examples, an OOW may be specific for a certain formation and/or hole size. As an example, an OOW may shift due to introduction of new bit, tools and/or technologies. As an example, an OOW may be subjected to one or more processes for alignment and/or realignment during execution. For example, consider data acquired while drilling that may indicate a location of a formation and/or a formation characteristic such that an OOW may be aligned or realigned based at least in part on such information. As an example, OOWs may have different priorities in the same field, which may depend on factors such as operator, regulations, business models, etc.

As explained, an OOW may be utilized to control one or more field operations. As an example, a system may provide for selecting RCS parameters based on one or more OOWs. For example, consider a system that may provide for selecting optimal control parameters based on identified optimal drilling parameters, which may be in the form of an OOW generated using an analysis based on offset well data, domain knowledge, and one or more models (e.g., physics-based, data-driven, hybrid, etc.). As an example, an RCS parameter selection process may be tailored to different desired behavior in different drilling scenarios (e.g., in different types of formations or at different locations in a given well section).

As an example, a system may identify comparable wells/runs to a target well/run and acquire data from these wells/runs. In such an example, based at least in part on the data, a system may generate an OOW for drilling parameters in the target well. Given the OOW, the system may select desired values for drilling parameters in the target well. For example, an OOW may be the basis of input as to context information for a target well (e.g., such as motor type and control limits). As explained, an OOW or OOWs may be provided for zones, where control may be implemented on a zone-by-zone basis. For example, consider a system that selects RCS setpoints for a given zone based on desired drilling parameters and regime.

As explained, an OOW may include recommended values for drilling control parameters and performance parameters for a given zone (e.g., a formation, a stand, another desired way of dividing up a trajectory, etc.).

As explained, an OOW may specify various drilling parameter values for parameters that may include, for example, WOB, top drive RPM, pump flow rate (FLWI), ROP and STOR.

As an example, for implementation of an OOW for control, a user and/or a machine may provide one or more additional limits to ensure equipment (e.g., surface or downhole) operates appropriately (e.g., with reduced risk of damage, etc.) and/or as to one or more other undesirable drilling conditions (e.g., consider setting of an ROP setpoint limit to ensure proper hole cleaning). As an example, limits may include a WOB limit, a torque limit, an ROP limit, a flowrate limit, a differential pressure limit, etc.

As an example, a system may include a translator where OOW information such as recommended parameter values are translated into appropriate control commands (e.g., RCS setpoints, etc.). For example, consider top drive torque limit and RPM setpoint, mud pumps flowrate, autodriller setpoints (e.g., WOB, ROP, Torque, DiffP), autodriller gains (e.g., tuning parameter values for control techniques such as proportional, integral, derivative, etc., types of control).

As an example, a system may include one or more translators, which may be selected based on one or more criteria, such as, for example, type of controller, level of automated control, regulations, company practices, etc. As an example, a translator may enable different translations of recommended parameter values depending upon the type of drilling desired in a given formation. As an example, in a hard interbedded formation, it may be desirable to ensure a maximum depth of cut is not exceeded, which may provide for drilling primarily under ROP control (e.g., rather than weight control). In other formations, drilling under WOB control may be more desirable.

As an example, different types of drilling modes may include a WOB mode where drilling is expected to be primarily drilling on WOB. In such a mode, the recommended drilling parameters may then be translated into RCS parameters as, for example: TD RPM setpoint=RPM recommendation; TD torque limit=torque limit (e.g., set by user, set by machine, etc.); flowrate setpoint=min(FLWI recommendation, flowrate limit); activate WOB and torque mode on autodriller (AD); send WOB recommendation as AD WOB setpoint; send 1.5*ROP prediction as ROP setpoint; and set AD torque setpoint to torque limit minus a margin (e.g., 2000 ft-lbs).

As an example, another mode may expect to involve primarily drilling on ROP, which may be referred to as an ROP mode. In such an example, the recommended drill parameters may be translated into RCS parameters as, for example: TD RPM setpoint=RPM recommendation; TD torque limit=torque limit (e.g., set by user, set by machine, etc.); flowrate setpoint=min(FLWI recommendation, flowrate limit); activate WOB and torque mode on autodriller (AD); send WOB limit as AD WOB setpoint; send ROP prediction as ROP setpoint; set AD torque setpoint to torque limit minus a margin (e.g., 2000 ft-lbs). In such a mode, a user may specify a maximum depth of cut desired (e.g., to limit bit cutter damage during formation changes). Such a value may be converted to a maximum ROP, and the ROP setpoint may then be the minimum between this maximum ROP and the ROP prediction to ensure that the maximum depth of cut is not exceeded.

While two example modes are given, one or more additional or alternative modes may be provided. For example, consider a mode selected based on desired drilling behavior. In such an example, a user may want more or less aggressive settings depending upon the current drilling conditions/context. If, for example, evidence suggests that there is no concern of bit/tool wear/damage, then an approach may select a more aggressive drilling mode (e.g., consider WOB mode but with a higher ROP setpoint value to ensure that ROP setpoint is not limiting the rate of drilling).

As an example, OOW and control may be linked in a workflow that includes OOW generation and/or linked in a post-OOW generation process. In various examples, where one or more OOW updates (e.g., alignments, realignments, etc.) are desired, a dynamic system may include OOW generation responsive to acquired data, control behavior, equipment condition, etc. As an example, a link may exist for purposes of planning where a planner (see, e.g., FIG. 4) may generate an executable plan for a control system. As an example, an OOW may be integrated into a plan for drilling a well/section, for example, based on expected target well design (BHA, trajectory, etc.).

As an example, an OOW or OOWs may form part of a static plan, which may be a basis for further planning. As an example, a user visualization of the real-time parameter usage as compared to a planned operating window and RCS settings may provide real-time visualization of compliance of actual operation with respect to the plan. In such an example, deviations from the plan may either be recorded (e.g., in shadow mode) and/or cause an alarm/flag to be raised (e.g., in an advisor mode). As an example, recorded compliance data may be used to improve an OOW workflow in post job analysis. For example, consider a scenario where an OOW is utilized with an autodriller where a level of automation may be decreased during drilling. Such a decrease in level of automation may indicate that the OOW did not provide sufficient confidence for at least a portion of the drilling. For example, a driller may have overridden one or more OOW parameter values due to domain knowledge. In such an example, the driller may provide feedback that may be utilized to improve the OOW or OOW generation, for example, to improve confidence in automated drilling.

As an example, an OOW may be a dynamic OOW such that, when implemented, the dynamic OOW may actively sense actual drilling conditions (e.g., presence or absence of vibrations or difficult formation type, etc.) and dynamically adjust the OOW based on real-time data. As an example, in a dynamic implementation, a system may be able to sense that a drilling process has arrived at a difficult formation earlier than expected and appropriately adjust the recommended drilling parameters. In such an example, one or more recommended RCS settings may be adjusted based on operation window and drilling regime.

Figure 23:
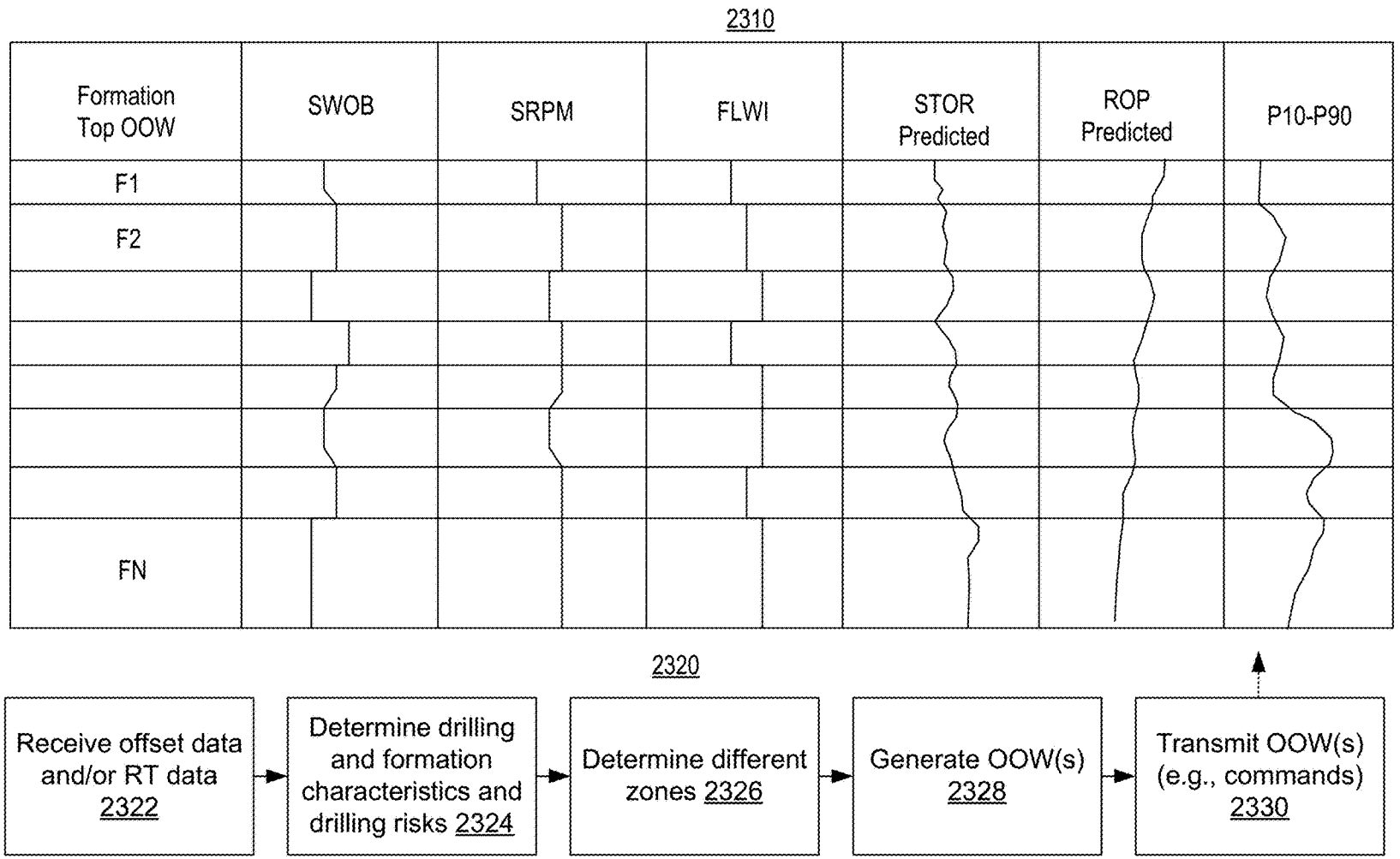
FIG. 23 shows an example of a graphical user interface (GUI) and an example of a method.

FIG. 23 shows an example of a graphical user interface (GUI) 2310 and an example of a method 2320 for controlling drilling operations, for example, using an RCS, which may include one or more automated drilling features (e.g., an autodriller). As shown, the GUI 2310 may include a listing of formations or zones (F1, F2, . . . FN) along with values for parameters such as SWOB, SRPM and FLWI. In such an example, STOR and ROP predictions may be presented along with statistical information such as P10-P90 information. In such an example, the confidence in recommendations may be assessed, whether via predictions, comparisons of predictions to actual, etc. As an example, a depth measurement may be an indicator for transitioning from one formation or zone to another. While depth is mentioned, as explained, one or more types of information (e.g., sensor data, etc.) may be utilized for determining when a change is appropriate.

In the example of FIG. 23, the method 2320 may include a reception block 2322 for receiving offset data and/or real-time (RT) data (e.g., from a rig site), a determination block 2324 for determining drilling and formation characteristics and drilling risks, a determination block 2326 for determining different zones (e.g., zone or intervals for a borehole to be drilled or further drilled), a generation block 2328 for generating one or more OOWs based on drilling and formation characteristics and drilling risks for one or more of the different zones (e.g., or a remaining portion of a zone, etc.), and a transmission block 2330 for transmission of the one or more OOW for one or more purposes, which may include use as a reference for a product and/or service delivery, use for generation of RCS commands (e.g., recommendations, etc.), use for generation of commands for automated drilling operations, etc. For example, the transmission block 2330 may transmit information in a digital form suitable for generation of the GUI 2310, which may be utilized for control of drilling operations, optionally in an automated and/or semi-automated manner.

As explained, a generation workflow for one or more OOWs may include performing mutation-based optimization where, for example, one or more parameter values may be mutated using one or more techniques to explore possible outcomes where such possible outcomes may be assessed with respect to one or more objectives to optimize the one or more parameter values to meet one or more of the one or more objectives. As an example, mutation techniques may be biased toward improved performance and may be tempered by risk. For example, if a parameter value is known to have a range where an upper portion of the range may increase risk, then a mutation technique may provide for exploration of values that do not extend into or do not extend far into the upper portion of the range. As an example, risk may also be assessed through use of one or more models, which may be or may include one or more simulation models (e.g., simulation of drilling, simulation of geomechanics, etc.). As an example, the method 2320 of FIG. 23 may aim to provide one or more OOWs that may have a high likelihood of achieving quality and performance objectives (e.g., as to borehole quality, equipment quality, etc.) while also achieving acceptable levels of risk.

Figure 24:
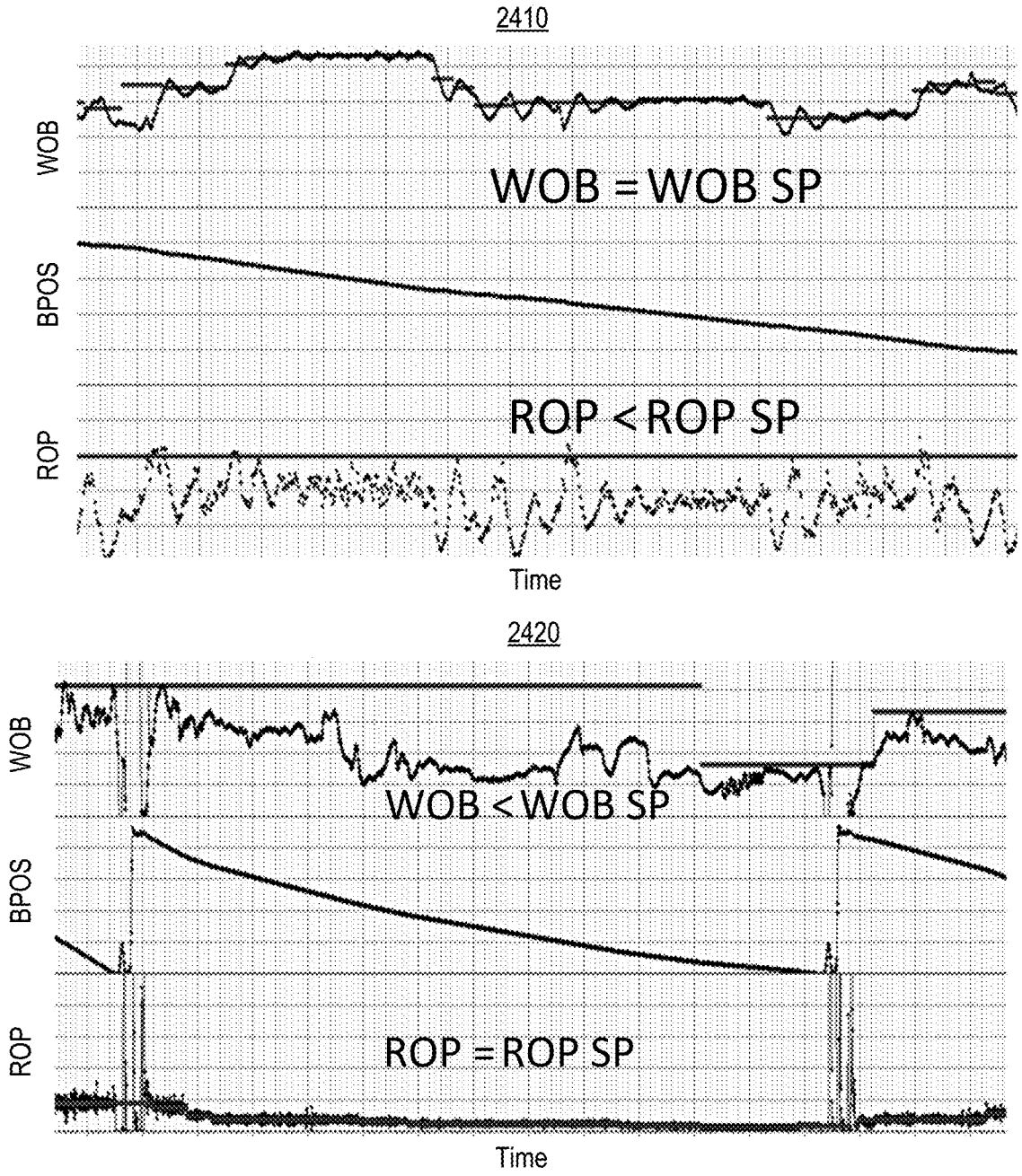
FIG. 24 shows examples of graphical user interfaces (GUIs)

FIG. 24 shows examples of graphical user interfaces (GUIs) 2410 and 2420 where the GUI 2410 includes WOB, WOB setpoint (SP), block position (BPOS), ROP and ROP setpoint (SP) versus time for a WOB mode of control and where the GUI 2420 includes WOB, WOB setpoint (SP), block position (BPOS), ROP and ROP setpoint (SP) versus time for an ROP mode of control. As shown, for the WOB mode, the ROP may be less than the ROP SP while WOB is controlled according to the time varying WOB SP per one or more OOWs, and, for the ROP mode, the WOB may be less than the WOB SP while ROP is controlled according to the time varying ROP SP per one or more OOWs.

As explained, one or more data-driven techniques may be implemented. For example, consider a workflow that may acquire data from offset wells where such data may include time series with depth information for drilling parameters, drilling dynamics, formation evaluation, etc., along with data as to equipment limits (e.g., rig, BHA, drill bit, etc.). Such data may be utilized in one or more ML approaches to training, whether supervised and/or unsupervised, one or more ML models. An ML model-based approach may provide for mutation-based optimization, for example, by inputting various parameter values to output information as to one or more objectives. As an example, one or more of classification and prediction may be utilized as part of an optimization scheme. As explained, a hybrid approach may be implemented that combines physics-based and data-driven techniques.

As an example, a workflow may include soft-hard transition zone prediction using a hybrid physics-based and data-driven ML model. As an example, a workflow may include automated offset well selection in real-time using a multidimensional similarity index. As an example, a workflow may include OOW recommendation in real-time using a normalized advantage function technique in deep reinforcement learning (DRL). As explained, a workflow may utilize one or more additional, alternative, etc., approaches.

As explained, a workflow may recommend drilling parameters in an updated manner using real-time data. For example, S & V, ROP and/or steerability channels may be fed in real-time to an OOW system where, for example, actual formation tops may be input (e.g., by a user, automatically, etc.). In such an example, a dynamic OOW workflow may use such information to update one or more OOWs.

As explained, a dynamic OOW workflow may be implemented to control equipment for one or more drilling operations, for example, in a data-driven manner. As an example, an initial OOW may be utilized to establish an initial state, for example, when a drill bit enters a new formation. As an example, over a course of a pre-defined interval (e.g., x meters or feet of MD), an automated process may compute one or more OOW performance indicators to assess performance as to OOW effectiveness. In such an approach, one or more thresholds may be utilized as to OOW effectiveness (e.g., defined by ROP, S & V, DLS, etc.) where a control system may decide to keep and/or adjust one or more recommended drilling parameter values.

As an example, adjusting may occur responsive to a comparison that considers OOW effectiveness. Such an approach may utilize real-time data acquired for a current formation, optionally along with a common portion interval from one or more selected offset wells, for example, to compute possible compensation, adjustment, etc., with respect to one or more objectives (e.g., for optimization, etc.). As an example, an adjustment may be applied to a remaining, upcoming portion of a current formation, for example, until a next interval (e.g., with an associated OOW recommendation, which may be altered or maintained).

Figure 25:
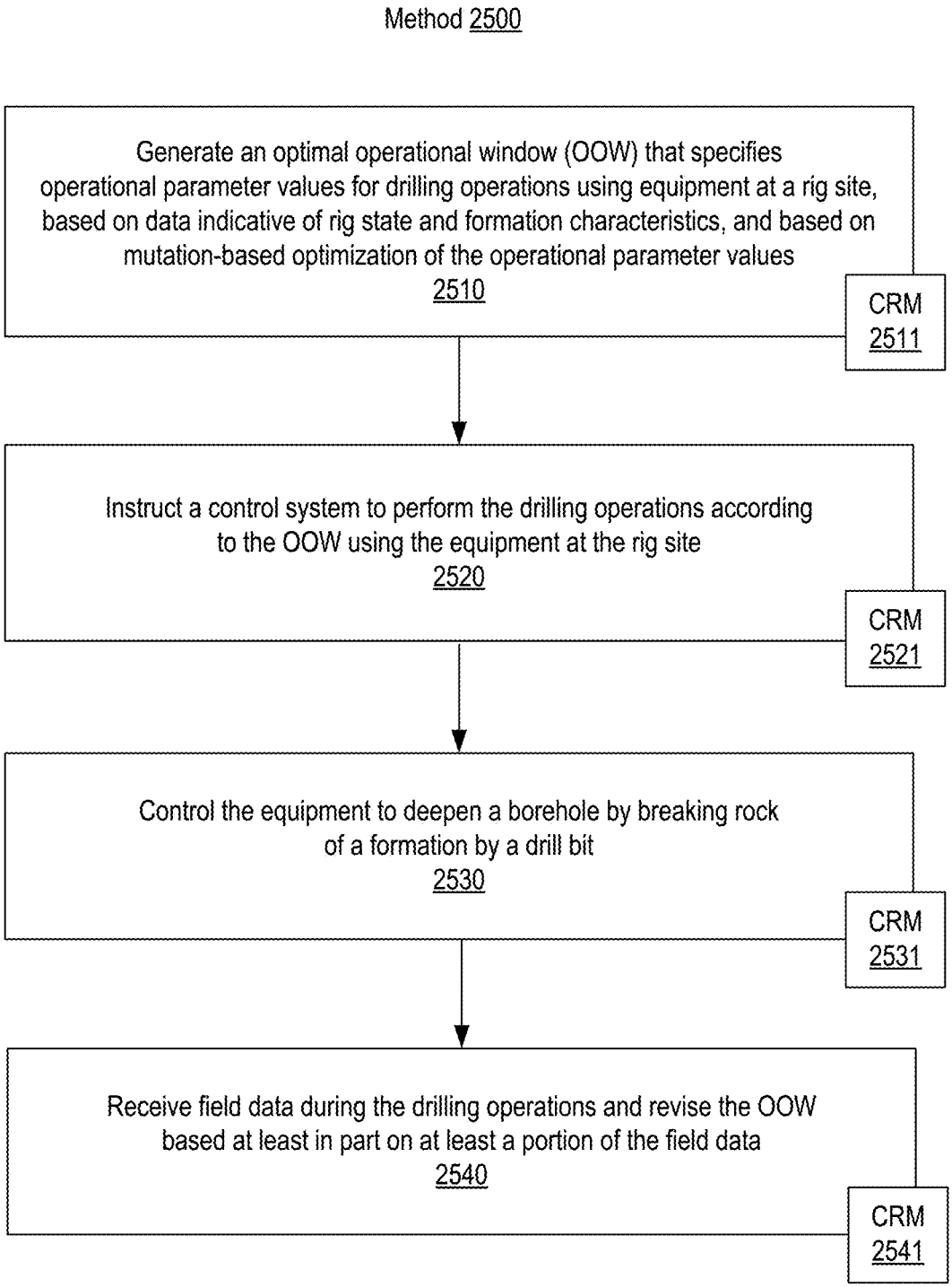
FIG. 25 shows an example of a method.

FIG. 25 shows an example of a method 2500 that may include a generation block 2510 for generating an optimal operational window (OOW) that specifies operational parameter values for drilling operations using equipment at a rig site, based on data indicative of rig state and formation characteristics, and based on mutation-based optimization of the operational parameter values; and an instruction block 2520 for instructing a control system to perform the drilling operations according to the OOW using the equipment at the rig site. As shown in the example of FIG. 25, the method 2500 may include a control block 2530 for, responsive to the instructing, controlling the equipment to deepen a borehole by breaking rock of a formation by a drill bit, and may include a revision block 2540 for receiving field data during the drilling operations and revising the OOW based at least in part on at least a portion of the field data.

As shown in FIG. 25, the method 2500 may be implemented via one or more computer-readable media (CRM) per blocks 2511, 2521, 2531 and 2541, which may, for example, be implemented using a system such as a computing system (see, e.g., the example system 300 of FIG. 3, etc.). Such blocks may include processor-executable instructions.

As explained, various systems, methods, etc., may implement one or more ML models, which may be data-driven models and/or hybrid models (e.g., physics-based and data-driven). As to types of ML models, consider one or more of a support vector machine (SVM) model, a k-nearest neighbors (KNN) model, an ensemble classifier model, a neural network (NN) model, incremental learning, Q-learning, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a system may utilize one or more recurrent neural networks (RNNs). One type of RNN is referred to as long short-term memory (LSTM), which may be a unit or component (e.g., of one or more units) that may be in a layer or layers. A LSTM component may be a type of artificial neural network (ANN) designed to recognize patterns in sequences of data, such as time series data. When provided with time series data, LSTMs take time and sequence into account such that an LSTM may include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, California) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As mentioned, a framework such as the PYTORCH framework may be utilized.

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, an ML model may be run online using cloud computation resources followed by an on-target well delivery approach that may automatically feed data to the ML model, which may be updated at a given frequency. As an example, a ML model may be run in an offline manner where a result or results may be transmitted to a planning workflow.

As an example, a method may include generating an optimal operational window (OOW) that specifies operational parameter values for drilling operations using equipment at a rig site, based on data indicative of rig state and formation characteristics, and based on mutation-based optimization of the operational parameter values; and instructing a control system to perform the drilling operations according to the OOW using the equipment at the rig site. In such an example, the generating the OOW may include accessing offset well data for multiple wells. In such an example, the method may include performing formation alignment on the offset well data with respect to the formation characteristics.

As an example, data may include surface sensor data and/or may include downhole sensor data. As an example, rig states may be derived from at least surface sensor data.

As an example, a method may include instructing a control system by selecting a mode of control from a plurality of different modes of control (e.g., consider an ROP mode, a WOB mode, etc.).

As an example, a method may include instructing a control system by instructing the control system to operate using one or more setpoints, one or more gains, or one or more setpoints and one or more gains as specified by an OOW or In such an example, a gain may be a gain of a controller that may perform at least some amount of automated control. For example, consider a proportional controller with a proportional gain (e.g., as a tuning parameter), an integral controller with an integral gain (e.g., as a tuning parameter), etc. In such examples, a setpoint may be specified where a gain or gains may be utilized in an effort to automatically maintain one or more operations at the setpoint.

As an example, a method may include mutation-based optimization of operational parameter values that may include adjusting values for two or more operational parameters to optimize drilling operations while accounting for one or more types of risk. In such an example, the one or more types of risk may include a risk associated with shock and vibration (S & V). As an example, one or more types of risk may include one or more of an equipment risk, a borehole quality risk, a drillstring and formation interaction risk, a mud motor degradation risk, a rotary steerable system (RSS) risk, and a drill bit damage risk, a stick slip risk, and a hard abrasive formation drilling risk, which may be in addition to or alternative to a risk associated with S & V.

As an example, a method may include generating an OOW by using one or more of a physics-based model, a data-driven model, and a hybrid physics-based and data-driven model.

As an example, a method may include, responsive to instructing a control system, controlling equipment to deepen a borehole by breaking rock of a formation by a drill bit.

As an example, a method may include receiving field data during drilling operations and revising an OOW based at least in part on at least a portion of the field data. As an example, a method may include assessing performance of one or more and utilizing such assessing as feedback for generation of one or more other OOWs.

As an example, a system may include at least one processor; memory accessible to at least one of the at least one processor; processor-executable instructions stored in the memory and executable to instruct the system to: generate an optimal operational window (OOW) that specifies operational parameter values for drilling operations using equipment at a rig site, based on data indicative of rig state and formation characteristics, and based on mutation-based optimization of the operational parameter values; and instruct a control system to perform the drilling operations according to the OOW using the equipment at the rig site. In such an example, the processor-executable instructions may include instructions executable to instruct the system to: receive field data during performance of one or more of the drilling operations and adjust the OOW based at least in part on a portion of the field data. In such an example, the portion of the field data may indicate a difference between one of the formation characteristics utilized to generate the OOW and an actual formation characteristic for a particular drilling zone of the OOW.

As an example, processor-executable instructions of a system may include instructions executable to instruct the system to: generate commands for control system, where the commands include one or more setpoints, one or more gains, or one or more setpoints and one or more gains, where the one or more gains may include at least one automated controller gain (e.g., proportional gain, integral gain, etc.).

As an example, processor-executable instructions of a system may include instructions executable to instruct the system to: generate commands for control system, where the commands include one or more of rate of penetration (ROP) setpoint commands for an ROP mode of control and weight-on-bit (WOB) setpoint commands for a WOB mode of control.

As an example, one or more non-transitory computer-readable storage media may include processor-executable instructions to instruct a computing system to: generate an optimal operational window (OOW) that specifies operational parameter values for drilling operations using equipment at a rig site, based on data indicative of rig state and formation characteristics, and based on mutation-based optimization of the operational parameter values; and instruct a control system to perform the drilling operations according to the OOW using the equipment at the rig site.

As an example, a computer program product that may include computer-executable instructions to instruct a computing system to perform one or more methods such as one or more of the methods described herein (e.g., in part, in whole and/or in various combinations).

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

Certain of the claims below may include numbered lists. The numbers are provided as an organizational tool to aid in readability. The numbers themselves do not indicate an expected order of configuration or execution or otherwise have substantive meaning. For United States applications, the claims that follow do not invoke section 112(f) unless the phrase "means for" is expressly used together with an associated function.

What is claimed is:

1. A method, comprising:

generating an optimal operational window (OOW) that specifies operational parameter values for drilling operations using equipment at a rig site, based on data indicative of rig state and formation characteristics, and based on optimization of the operational parameter values using at least one heatmap corresponding to each operational parameter, the generating the OOW including performing formation alignment on offset well data for multiple wells with respect to the formation characteristics, the OOW indicating a range of depths at which the optimized operational parameter values are used by the equipment at the rig site based on an average length of each formation characteristic;

instructing a control system to perform the drilling operations according to the OOW using the equipment at the rig site;

responsive to instructing the control system, using a drill bit included in the equipment to deepen a borehole by breaking rock in a formation;

receiving, during the drilling operations, field data associated with the drilling operations; and updating the OOW based in part on the field data.

2. The method of claim 1, wherein the performing formation alignment on offset well data comprises:

determining an average length of the multiple wells in the formation;

determining, based in part on the average length, a first coefficient for a first well included in the multiple wells; and shrinking, based in part on the first coefficient, a graph of the operational parameters associated with the first well to fit to the average length.

3. The method of claim 2, further comprising:

determining, based in part on the average length, a second coefficient for a second well included in the multiple wells; and expanding, based in part on the second coefficient, a graph of the operational parameters associated with the second well to fit to the average length.

4. The method of claim 1, wherein the data comprises surface sensor data.

5. The method of claim 4, wherein the data further comprises downhole sensor data.

6. The method of claim 4, wherein each rig state is derived from at least the surface sensor data.

7. The method of claim 1, wherein the instructing the control system comprises selecting a mode of control from a plurality of different modes of control.

8. The method of claim 1, wherein the instructing the control system comprises instructing the control system to operate using one or more setpoints, one or more gains, or one or more setpoints and one or more gains as specified by the OOW.

9. The method of claim 1, wherein the optimization of the operational parameter values comprises adjusting values for two or more operational parameters to optimize the drilling operations while accounting for one or more types of risk.

10. The method of claim 9, wherein:

the one or more types of risk comprise a risk associated with shock and vibration; and one or more of the heatmaps comprise shock and vibration operational parameters mapped with respect to a weight-on-bit axis and a drill bit rotational speed axis.

11. The method of claim 9, wherein:

the one or more types of risk comprise one or more of an equipment risk, a borehole quality risk, a drillstring and formation interaction risk, a mud motor degradation risk, a rotary steerable system (RSS) risk, a drill bit damage risk, a stick slip risk, and a hard abrasive formation drilling risk; and one or more of the heatmaps comprise operational parameters that correspond to one or more of the one or more types of risk.

12. The method of claim 1, wherein:

the generating the OOW comprises using one or more of a physics-based model, a data-driven model, and a hybrid physics-based and data-driven model; and one or more of the heatmaps comprise one or more of operational parameters generated by the physics-based model, operational parameters generated by the data-driven model, and operational parameters generated by the hybrid physics-based and data-driven model.

13. The method of claim 1, further comprising rendering the heatmaps, as part of a graphical user interface, to a display.

14. The method of claim 1, wherein:

the performing formation alignment on offset well data comprises:

determining an average length of a portion of each of the multiple wells in the formation, the portion corresponding to a same formation characteristic for each of the multiple wells;

determining, based in part on the average length of the portion of each of the multiple wells, a first coefficient for a first well among the multiple wells;

shrinking, based in part on the first coefficient, a graph of the operational parameters associated with the first well to fit to the average length;

determining, based in part on the average length of the portion of each of the multiple wells, a second coefficient for a second well among the multiple wells; and expanding, based in part on the second coefficient, a graph of the operational parameters associated with the second well to fit to the average length of the portion of each of the multiple wells; and the average length of the portion of each of the multiple wells is a size of the OOW for the formation characteristic.

15. A system, comprising:

at least one processor;

memory accessible to at least one of the at least one processor; and processor-executable instructions stored in the memory and executable to instruct the system to:

generate an optimal operational window (OOW) that specifies operational parameter values for drilling operations using equipment at a rig site, based on data indicative of rig state and formation characteristics, and based on optimization of the operational parameter values using at least one heatmap corresponding to each operational parameter, the generating the OOW including performing formation alignment on offset well data for multiple wells with respect to the formation characteristics, the OOW indicating a range of depths at which the optimized operational parameter values are used by the equipment at the rig site based on an average length of each formation characteristic;

control, according to the OOW, a drill bit included in the equipment at the rig site to deepen a borehole by breaking rock in a formation;

receive, during the drilling operations, field data associated with the drilling operations; and update the OOW based in part on the field data.

16. The system of claim 15, wherein the processor-executable instructions comprise instructions executable to instruct the system to render the heatmaps, as part of a graphical user interface, to a display.

17. The system of claim 15, wherein at least a portion of the field data indicates a difference between one of the formation characteristics utilized to generate the OOW and an actual formation characteristic for a particular drilling zone of the OOW.

18. The system of claim 15, wherein;

the processor-executable instructions comprise instructions executable to instruct the system to generate commands for a control system;

the commands comprise one or more setpoints, one or more gains, or one or more setpoints and one or more gains; and the one or more gains comprise at least one automated controller gain.

19. The system of claim 15, wherein:

the processor-executable instructions comprise instructions executable to instruct the system to generate commands for a control system; and the commands comprise one or more of: rate of penetration (ROP) setpoint commands for an ROP mode of control or weight-on-bit (WOB) setpoint commands for a WOB mode of control.

20. One or more non-transitory computer-readable storage media comprising processor-executable instructions to instruct a computing system to:

generate an optimal operational window (OOW) that specifies operational parameter values for drilling operations using equipment at a rig site, based on data indicative of rig state and formation characteristics, and based on optimization of the operational parameter values using at least one heatmap corresponding to each operational parameter, the generating the OOW including performing formation alignment on offset well data for multiple wells with respect to the formation characteristics, the OOW indicating a range of depths at which the optimized operational parameter values are used by the equipment at the rig site based on an average length of each formation characteristic;

control, according to the OOW, a drill bit included in the equipment at the rig site to deepen a borehole by breaking rock in a formation;

receive, during the drilling operations, field data associated with the drilling operations; and update the OOW based in part on the field data.

* * * * *